US007252602B2

(12) United States Patent
Sajima et al.

(10) Patent No.: US 7,252,602 B2
(45) Date of Patent: Aug. 7, 2007

(54) GOLF BALL

(75) Inventors: Takahiro Sajima, Kobe (JP); Takashi Sasaki, Kobe (JP); Keiji Ohama, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 0 days.

(21) Appl. No.: 11/260,373

(22) Filed: Oct. 28, 2005

(65) Prior Publication Data

US 2006/0116222 A1 Jun. 1, 2006

(30) Foreign Application Priority Data

Dec. 1, 2004 (JP) ..... 2004-348321

(51) Int. Cl.
*A63B 37/14* (2006.01)

(52) U.S. Cl. ..... 473/383

(58) Field of Classification Search ..... 473/383–384
See application file for complete search history.

(56) References Cited

U.S. PATENT DOCUMENTS 5,338,039 A 8/1994 Oka et al.
5,735,757 A 4/1998 Moriyama
6,599,204 B2 * 7/2003 Kasashima et al. ..... 473/383
6,899,643 B2 * 5/2005 Sajima et al. ..... 473/383
6,951,520 B2 * 10/2005 Ohama et al. ..... 473/383
2006/0116220 A1 * 6/2006 Ohama et al. ..... 473/371
2006/0154749 A1 * 7/2006 Ohama et al. ..... 473/378

* cited by examiner

*Primary Examiner*—Raeann Trimiew
(74) *Attorney, Agent, or Firm*—Birch, Stewart, Kolasch & Birch, LLP

(57) ABSTRACT

Golf ball 2 has numerous double radius dimples and numerous triple radius dimples on the surface thereof. The double radius dimple has a first side wall face having a curvature radius R1, and a bottom face having a curvature radius R2 that is 5 times or more and 55 times or less greater than the curvature radius R1 and being positioned on the bottom side than the first side wall face. The triple radius dimple has a first side wall face having a curvature radius that is greater than the phantom curvature radius Rx, a second side wall face being positioned on the bottom side than the first side wall face and having a curvature radius that is smaller than the phantom curvature radius Rx, and a bottom face being positioned on the bottom side than the second side wall face and having a curvature radius that is greater than the phantom curvature radius Rx. Proportion of the number of the double radius dimples in total number of the dimples is 20% or greater and 42% or less, and proportion of the number of the triple radius dimples is equal to or greater than 50%.

6 Claims, 22 Drawing Sheets

GOLF BALL

This application claims priority on Patent Application No. 2004-348321 filed in JAPAN on Dec. 1, 2004. The entire contents of this Japanese Patent Application are hereby incorporated by reference.

BACKGROUND OF THE INVENTION

1. Field of the Invention

The present invention relates to golf balls. More particularly, the present invention relates to improvements of dimples of golf balls.

2. Description of the Related Art

Golf balls have numerous dimples on the surface thereof. In general, golf balls have single radius dimples having a cross-sectional shape with single curvature radius, or double radius dimples having a cross-sectional shape with two curvature radii. The dimples disrupt the air flow around the golf ball during flight to cause turbulent flow separation. By causing the turbulent flow separation, separating points of the air from the golf ball shift backwards leading to the reduction of a drag. The turbulent flow separation promotes the differentia between the separating point on the upper side and the separating point on the lower side of the golf ball, which result from the backspin, thereby enhancing the lift force that acts upon the golf ball. Such a role of the dimples is referred to as a "dimple effect". Excellent dimples disturb the air flow more efficiently.

A variety of proposals with respect to the sectional shape of the dimples in attempts to improve flight performances have been made. U.S. Pat. No. 5,338,039 discloses dimples having a shape with the gradient of a slope disposed in the vicinity of the edge being greater than that of a slope at the bottom part. U.S. Pat. No. 5,735,757 discloses dimples having a cross-sectional shape given by double radius.

When a golf ball is hit with a short iron, the surface thereof may be scuffed. In case of golf balls having double radius dimples, in particular, margin of the dimple is liable to be scuffed resulting from concentration of the stress. There also remains room for improvement of the double radius dimple in respect of the scuff resistance. An object of the present invention is to provide a golf ball that is excellent in the flight performance and scuff resistance.

SUMMARY OF THE INVENTION

Golf ball according to the present invention has numerous double radius dimples and numerous triple radius dimples on the surface thereof. This double radius dimple has a first side wall face having a curvature radius R1, and a bottom face having a curvature radius R2 that is 5 times or more and 55 times or less greater than the curvature radius R1 and being positioned on the bottom side than the first side wall face. This triple radius dimple has a first side wall face having a curvature radius R1 that is equal to or greater than the phantom curvature radius Rx, a second side wall face being positioned on the bottom side than the first side wall face and having a curvature radius R2 that is smaller than the phantom curvature radius Rx, and a bottom face being positioned on the bottom side than the second side wall face and having a curvature radius R3 that is equal to or greater than the phantom curvature radius Rx. Proportion of the number of the double radius dimples in total number of the dimples is 20% or greater and 42% or less. Proportion of the number of the triple radius dimples in total number of the dimples is equal to or greater than 50%. In the invention, the phantom curvature radius Rx means a curvature radius of a phantom dimple. This phantom dimple means a single radius dimple having an equal diameter to the diameter of the dimple, and an equal volume to the volume of the dimple.

Preferably, in the double radius dimple, the depth of the first side wall face is 0.20 time or more and 0.70 time or less greater than the depth of the double radius dimple. Preferably, in the double radius dimple, the maximum diameter of the bottom face is 0.60 time or more and 0.95 time or less greater than the diameter of the double radius dimple.

Preferably, in the triple radius dimple, the depth of the first side wall face is 0.10 time or more and 0.50 time or less greater than the depth of the triple radius dimple. Preferably, in the triple radius dimple, the maximum diameter of the second side wall face is 0.60 time or more and 0.95 time or less greater than the diameter of the triple radius dimple.

Preferably, the first side wall face and the bottom face of the double radius dimple, and the first side wall face, the second side wall face and the bottom face of the triple radius dimple are convex downward.

As described above, double radius dimples are excellent in flight performance, however, they are inferior in scuff resistance. In the golf ball according to the present invention, scuff resistance is compensated by the triple radius dimple. In this golf ball, owing to synergistic effect of the double radius dimple and the triple radius dimple, extremely excellent flight performance is achieved. In this golf ball, both flight performance and scuff resistance are concomitantly accomplished.

DESCRIPTION OF THE PREFERRED EMBODIMENTS

The present invention is hereinafter described in detail with appropriate references to the accompanying drawing according to the preferred embodiments of the present invention.

Figure 1:
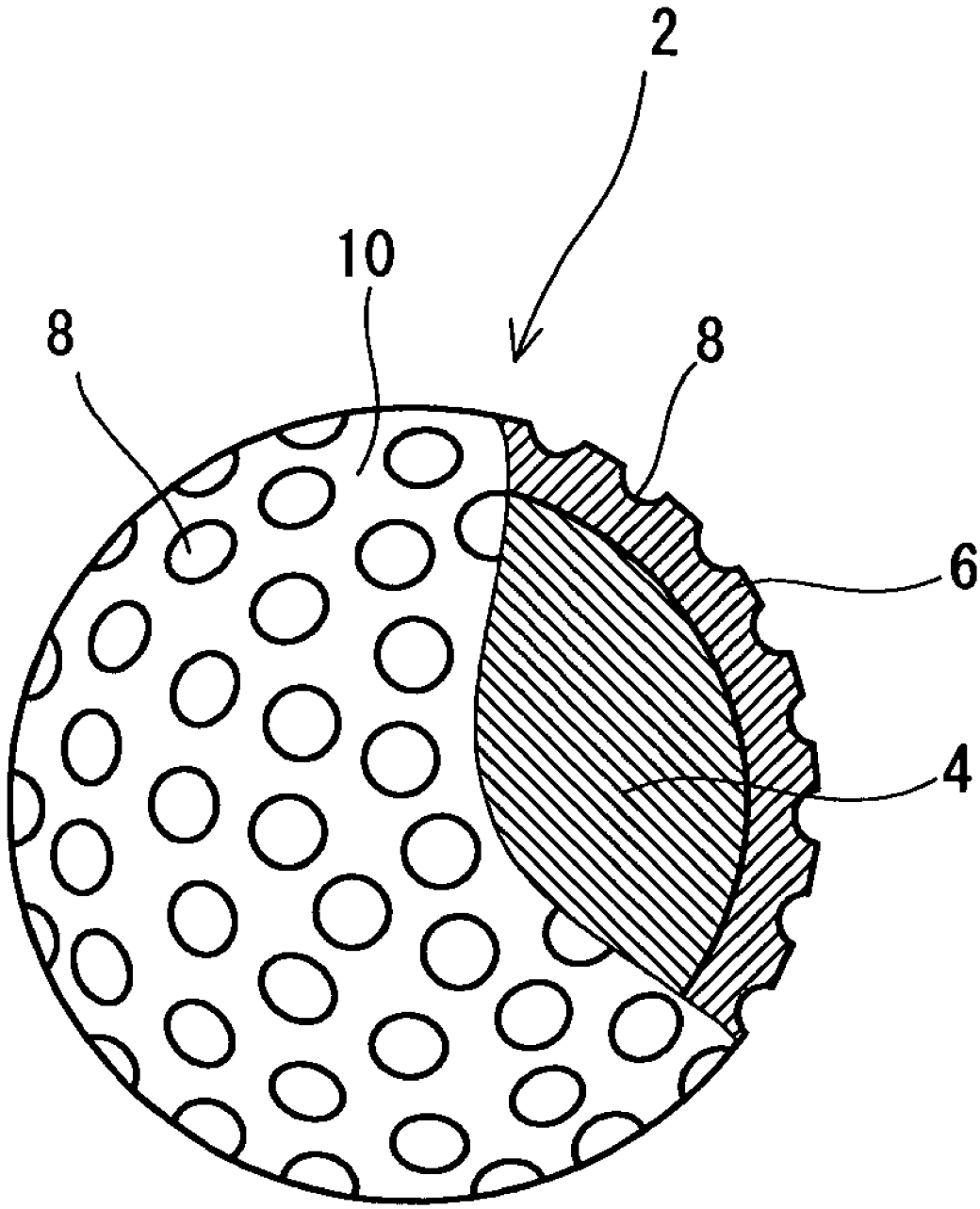
FIG. 1 is a schematic cross-sectional view illustrating a golf ball according to one embodiment of the present invention.

A golf ball 2 illustrated in FIG. 1 has a spherical core 4 and a cover 6. Numerous dimples 8 are formed on the surface of the cover 6. Of the surface of the golf ball 2, a part except for the dimples 8 is a land 10. This golf ball 2 has a paint layer and a mark layer to the external side of the cover 6, although these layers are not shown in the Figure.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. Weight of this golf ball 2 is 40 g or greater and 50 g or less. In light of attainment of great inertia, the weight is preferably equal to or greater than 44 g, and particularly preferably equal to or greater than 45.00 g. From the standpoint of conformity to a rule defined by USGA, the weight is preferably equal to or less than 45.93 g.

The core 4 is formed by crosslinking a rubber composition. Illustrative examples of the base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred, and high cis-polybutadienes are particularly preferred.

For crosslinking of the core 4, a co-crosslinking agent is usually used. Examples of the co-crosslinking agent that is preferable in light of the resilience performance include zinc acrylate, magnesium acrylate, zinc methacrylate and magnesium methacrylate. Into the rubber composition, an organic peroxide may be preferably blended together with the co-crosslinking agent. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide.

Various kinds of additives such as a filler, a sulfur compound, an anti-aging agent, a coloring agent, a plasticizer, a dispersant and the like may be blended at an adequate amount into the rubber composition of the core 4 as needed. Into the rubber composition may be also blended crosslinked rubber powder or synthetic resin powder.

The core 4 has a diameter of equal to or greater than 30.0 mm and particularly preferably equal to or greater than 38.0 mm. The core 4 has a diameter of equal to or less than 42.0 mm and particularly preferably equal to or less than 41.5 mm. The core 4 may be composed of two or more layers.

Polymer which may be suitably used in the cover 6 is an ionomer resin. Particularly, an ionomer resin is suitable which is a copolymer of α-olefin and an α,β-unsaturated carboxylic acid having 3 to 8 carbon atoms in which a part of the carboxylic acid is neutralized with a metal ion. Examples of preferable α-olefin include ethylene and propylene. Examples of preferable α,β-unsaturated carboxylic acid include acrylic acid and methacrylic acid. Illustrative examples of the metal ion for use in neutralization include sodium ion, potassium ion, lithium ion, zinc ion, calcium ion, magnesium ion, aluminum ion and neodymium ion. The neutralization may be carried out with two or more kinds of metal ions. Particularly suitable metal ions in light of the resilience performance and durability of the golf ball 2 are sodium ion, zinc ion, lithium ion and magnesium ion.

Other polymer may be used in place of or together with the ionomer resin. Illustrative examples of the other polymer include thermoplastic styrene elastomers, thermoplastic polyurethane elastomers, thermoplastic polyamide elastomers, thermoplastic polyester elastomers and thermoplastic polyolefin elastomers.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 6 may be also blended with powder of a highly dense metal such as tungsten, molybdenum or the like for the purpose of adjusting the specific gravity.

The cover 6 has a thickness of equal to or greater than 0.5 mm, and particularly preferably equal to or greater than 0.8 mm. The cover 6 has a thickness of equal to or less than 2.5 mm, and particularly preferably equal to or less than 2.2 mm. The cover 6 has a specific gravity of equal to or greater than 0.90, and particularly preferably equal to or greater than 0.95. The cover 6 has a specific gravity of equal to or less than 1.10, and particularly preferably equal to or less than 1.05. The cover 6 may be composed of two or more layers.

Figure 2:
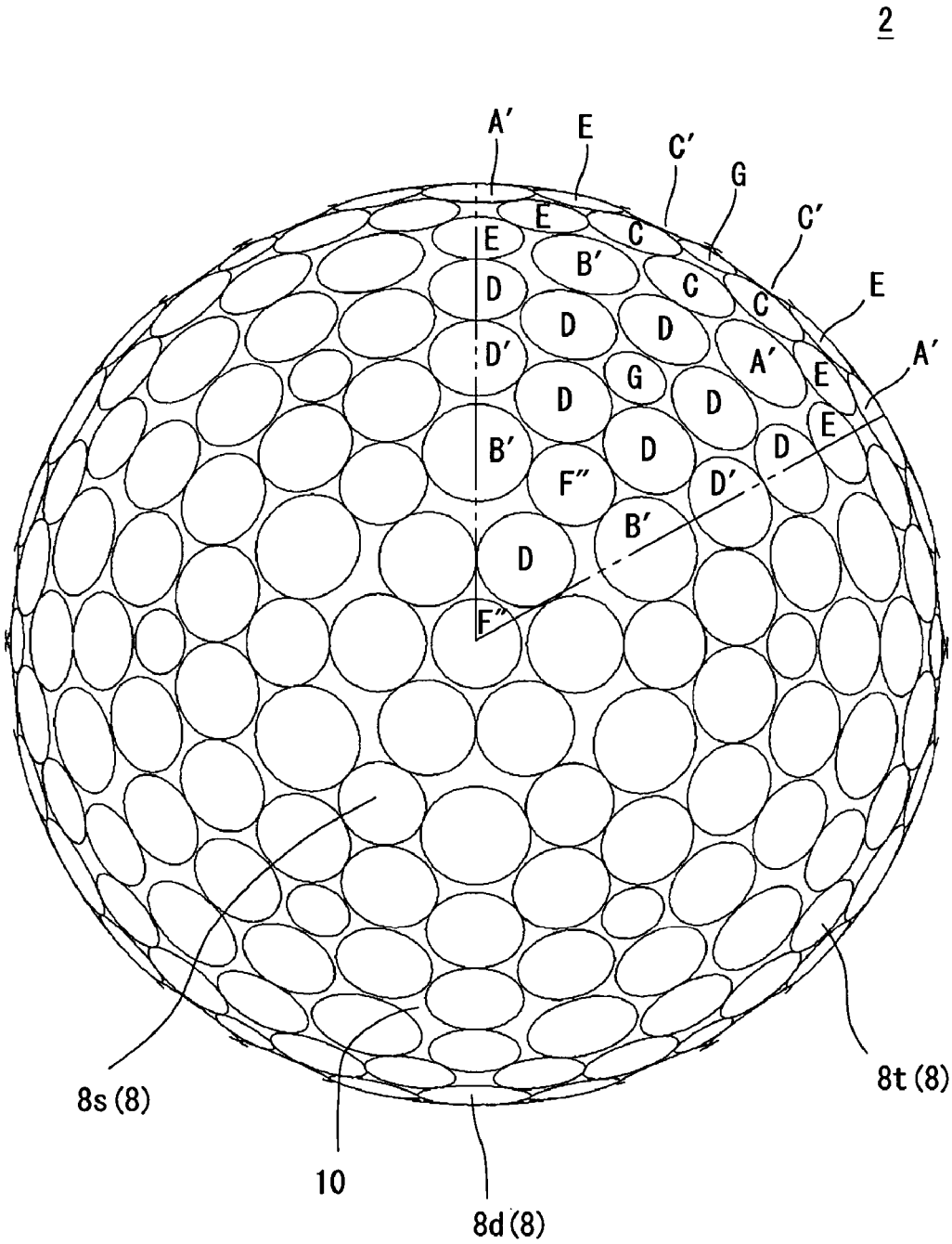
FIG. 2 is an enlarged plan view illustrating the golf ball shown in FIG. 1.
Figure 3:
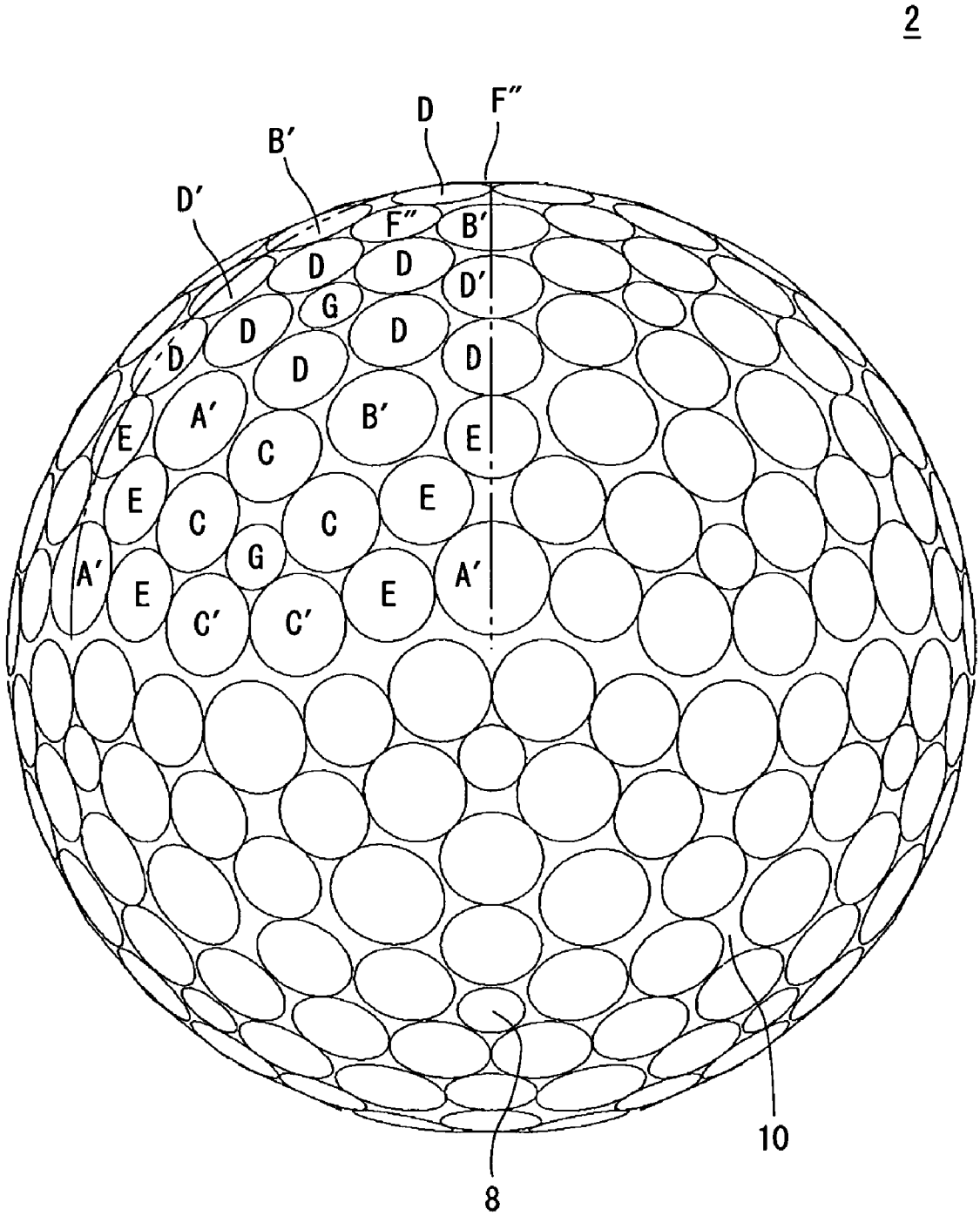
FIG. 3 is a front view illustrating the golf ball shown in FIG. 2.

FIG. 2 is an enlarged plan view illustrating the golf ball 2 shown in FIG. 1; and FIG. 3 is a front view of the same. As is clear from FIG. 2 and FIG. 3, the plane shape of all the dimples 8 is circular. In FIG. 2 and FIG. 3, kinds of the dimples 8 are illustrated by symbols in one unit, provided when the surface of the golf ball 2 is comparted into twelve equivalent units. This golf ball 2 has dimples A' having a diameter of 5.10 mm, dimples B' having a diameter of 5.00 mm, dimples C having a diameter of 4.60 mm, dimples C' having a diameter of 4.60 mm, dimples D having a diameter of 4.50 mm, dimples D' having a diameter of 4.50 mm, dimples E having a diameter of 4.20 mm, dimples F" having a diameter of 4.00 mm, and dimples G having a diameter of 3.00 mm. The number of the dimples A' is 24; the number of the dimples B' is 24; the number of the dimples C is 36; the number of the dimples C' is 24; the number of the dimples D is 84; the number of the dimples D' is 12; the number of the dimples E is 60; the number of the dimples F" is 14; and the number of the dimples G is 24. Total number of the dimples 8 of this golf ball 2 is 302.

The dimples A', B', C' and D' are double radius dimples 8*d*. The dimples C, D, E and G are triple radius dimples 8*t*. The dimple F" is a single radius dimple 8*s*.

Figure 4:
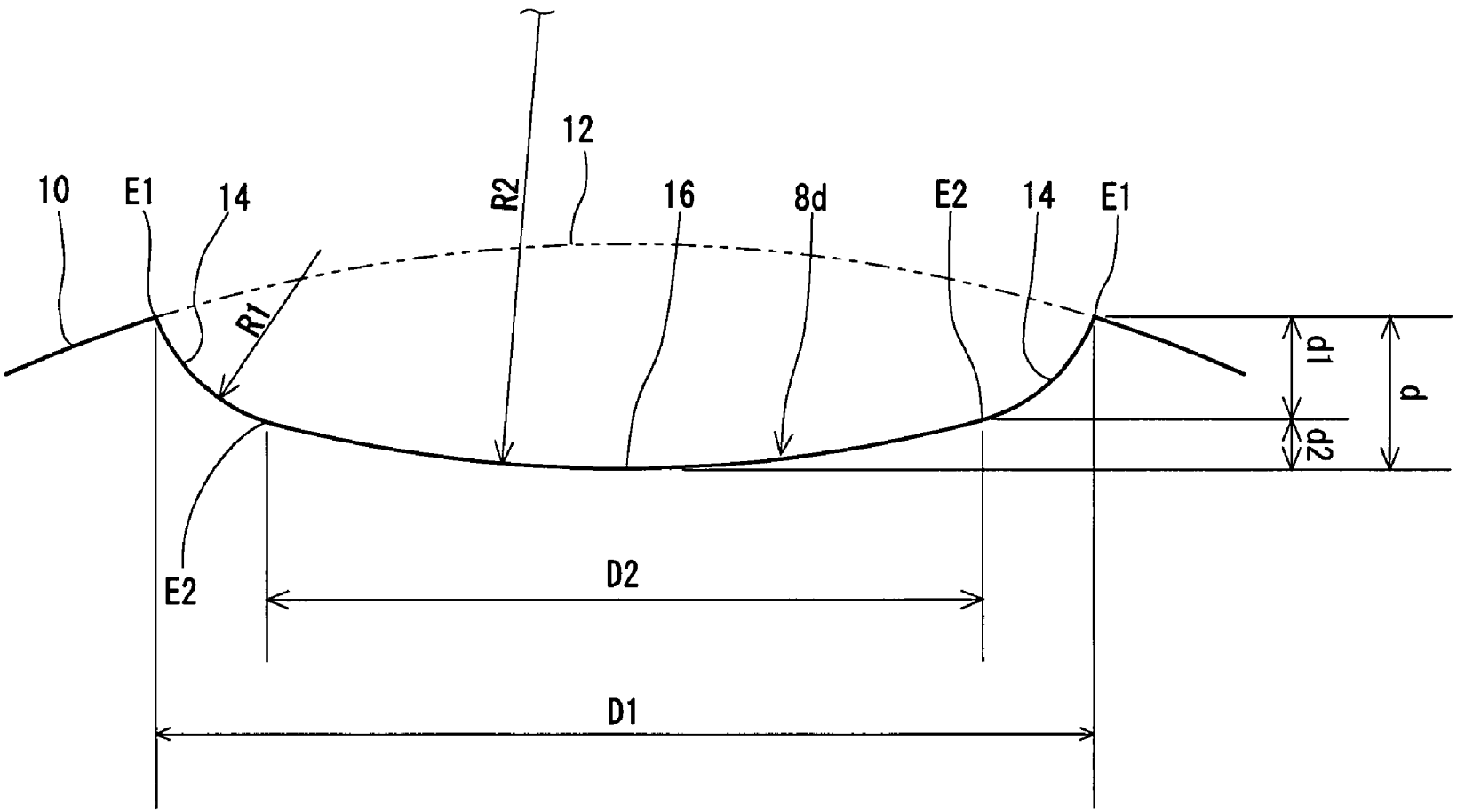
FIG. 4 is an enlarged cross-sectional view illustrating a part of the golf ball shown in FIG. 1.

FIG. 4 is an enlarged cross-sectional view illustrating a part of the golf ball 2 shown in FIG. 1. In this FIG. 4, a double radius dimple 8*d* is illustrated. In this FIG. 4, a cross section along a plane passing through the weighted center of area of the dimple 8*d* and the center of the golf ball 2 is shown. A top-to-bottom direction in FIG. 4 is an in-depth direction of the dimple 8*d*. The in-depth direction is a direction from the weighted center of area of the dimple 8*d* toward the center of the golf ball 2. What is indicated by a chain double-dashed line 12 in FIG. 4 is a phantom sphere. The surface of the phantom sphere 12 corresponds to a surface of the golf ball 2 when it is postulated that there is no dimple 8*d* present. The dimple 8*d* is recessed from the phantom sphere 12. The land 10 agrees with the phantom sphere 12.

This dimple 8*d* has a first side wall face 14 and a bottom face 16. The first sidewall face 14 is ring shaped. The bottom face 16 is bowl shaped. The first side wall face 14 is continued to the land 10 at a point E1. The point E1 corresponds to the edge of the dimple 8*d*. The edge E1 defines plane shape of the dimple 8*d*. The edge E1 may be rounded. The bottom face 16 is positioned on the bottom side of the first side wall face 14. The bottom face 16 is continued to the first side wall face 14 at a point E2. The bottom face 16 is in contact with the first side wall face 14.

What is indicated by a both-oriented arrowhead D1 in FIG. 4 is the diameter of the dimple 8*d*. This diameter D1 is also a maximum diameter of the first side wall face 14. What is indicated by a both-oriented arrowhead D2 is a maximum diameter of the bottom face 16. The diameter D1 of the dimple 8*d* is preferably 2.0 mm or greater and 6.0 mm or less. When the diameter D1 is less than the above range, dimple effect may be hardly exerted. In this respect, the diameter D1 is more preferably equal to or greater than 2.2 mm, and particularly preferably equal to or greater than 2.4 mm. When the diameter D1 is beyond the above range, a feature of the golf ball 2 which is substantially a sphere may be compromised. In this respect, the diameter D1 is more preferably equal to or less than 5.8 mm, and particularly preferably equal to or less than 5.6 mm.

The first side wall face 14 is convex downward. Maximum diameter line of the first side wall face 14 passes through the point E1. In other words, the first side wall face 14 does not run off the point E1 outside in the horizontal direction. Accordingly, accumulation of the air is prevented. The undermost point of the first side wall face 14 agrees with the point E2. In other words, the first side wall face 14 inclines downward from the point E1 to the point E2. Accordingly, accumulation of the air is prevented.

The bottom face 16 is convex downward. Maximum diameter line of the bottom face 16 passes through the point E2. In other words, the bottom face 16 does not run off the point E2 outside in the horizontal direction. Accordingly, accumulation of the air is prevented.

What is indicated by an arrowhead R1 in FIG. 4 is the curvature radius of the first side wall face 14, and what is indicated by an arrowhead R2 is a curvature radius of the bottom face 16. The curvature radius R2 is greater than the curvature radius R1. In other words, first side wall face 14 is a steep slope, while the bottom face 16 is a gentle slope. In this dimple 8*d*, the ratio (R2/R1) is equal to or greater than 5. This ratio (R2/R1) is greater than the ratio (R2/R1) of conventional double radius dimples. This dimple 8*d* is responsible for the flight performance of the golf ball 2. Although grounds for contribution of this dimple 8*d* to the flight performance of the golf ball 2 is uncertain in detail, it is speculated that air flow from the land 10 toward the deepest place is disrupted due to great ratio (R2/R1), thereby the drag being reduced. In light of the flight performance, the ratio (R2/R1) is more preferably equal to or greater than 10, and particularly preferably equal to or greater than 20. When the ratio (R2/R1) is too great, the air flow on the bottom face 16 becomes monotonous, therefore, the ratio (R2/R1) is preferably equal to or less than 55, and more preferably equal to or less than 50. The curvature radius R1 is preferably 0.3 mm or greater and 10.0 mm or less. The curvature radius R2 is preferably 2.0 mm or greater and 60.0 mm or less.

Maximum diameter D2 of the bottom face 16 is preferably 0.60 time or more and 0.95 time or less greater than the diameter D1 of the dimple 8*d*. When the diameter D2 is less than the above range, contributing rate of the bottom face 16 to the dimple effect may become insufficient. In this respect, the diameter D2 is more preferably equal to or more than 0.70 time, and particularly preferably equal to or more than 0.75 time greater than the diameter D1. When the diameter D2 is beyond the above range, contributing rate of first side wall face 14 to the dimple effect may become insufficient. In this respect, the diameter D2 is more preferably equal to or less than 0.93 time, and particularly preferably equal to or less than 0.90 time greater than the diameter D1.

What is indicated by a both-oriented arrowhead d1 in FIG. 4 is the depth of the first side wall face 14; what is indicated by a both-oriented arrowhead d2 is the depth of the bottom face 16. Sum total of the depth d1 and the depth d2 is the depth d of the dimple 8*d*.

The depth d1 of the first side wall face 14 is preferably 0.20 time or more and 0.70 time or less greater than the depth d of the dimple 8*d*. When the depth d1 is less than the above range, contributing rate of the first side wall face 14 to the dimple effect may become insufficient. In this respect, the depth d1 is more preferably equal to or more than 0.22 time, and particularly preferably equal to or more than 0.25 time greater than the depth d. When the depth d1 is beyond the above range, contributing rate of the bottom face 16 to the dimple effect may become insufficient. In this respect, the depth d1 is more preferably equal to or less than 0.68 time, and particularly preferably equal to or less than 0.65 time greater than the depth d.

Figure 5:
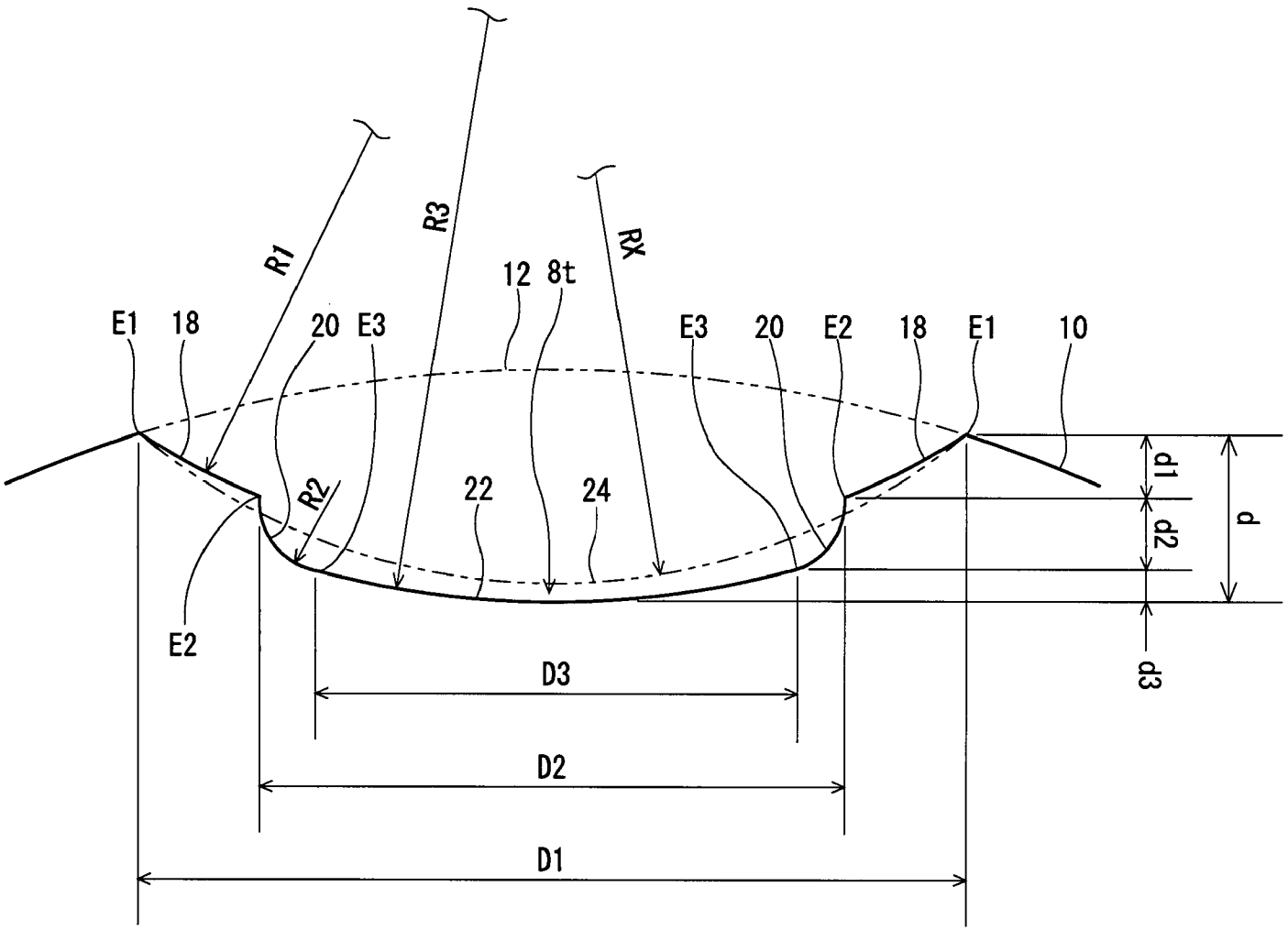
FIG. 5 is an enlarged cross-sectional view illustrating a part of the golf ball shown in FIG. 1.

FIG. 5 is an enlarged cross-sectional view illustrating a part of the golf ball 2 shown in FIG. 1. In this FIG. 5, a triple radius dimple 8*t* is illustrated. This dimple 8*t* has a first side wall face 18, a second side wall face 20 and a bottom face 22. The first side wall face 18 and the second side wall face 20 are ring shaped. The bottom face 22 is bowl shaped. The first side wall face 18 is continued to the land 10 at an edge E1. The edge E1 may be rounded. The second side wall face 20 is positioned on the bottom side of the first side wall face 18. The second side wall face 20 is continued to the first side wall face 18 at a point E2. The bottom face 22 is positioned on the bottom side of the second side wall face 20. The bottom face 22 is continued to the second side wall face 20 at a point E3. The bottom face 22 is in contact with the second side wall face 20.

What is indicated by a both-oriented arrowhead D1 in FIG. 5 is the diameter of the dimple 8*t*. This diameter D1 is also the maximum diameter of the first side wall face 18. What is indicated by a both-oriented arrowhead D2 is the maximum diameter of the second side wall face 20. What is indicated by a both-oriented arrowhead D3 is the maximum diameter of the bottom face 22. The diameter D1 of the dimple 8*t* is preferably 2.0 mm or greater and 6.0 mm or less. When the diameter D1 is less than the above range, dimple effect may be hardly exerted. In this respect, the diameter D1 is more preferably equal to or greater than 2.2 mm, and particularly preferably equal to or greater than 2.4 mm. When the diameter D1 is beyond the above range, a feature of the golf ball 2 which is substantially a sphere may be compromised. In this respect, the diameter D1 is more preferably equal to or less than 5.8 mm, and particularly preferably equal to or less than 5.6 mm.

In FIG. 5, what is indicated by a chain double-dashed line 24 is a phantom dimple. The phantom dimple 24 has a cross-sectional shape of a circular arc. Curvature radius of this circular arc is denoted by a symbol Rx in. FIG. 5. This phantom dimple 24 is a single radius dimple. The phantom dimple 24 has a diameter of D1. In other words, the phantom dimple 24 has a diameter that is equal to the diameter of the triple radius dimple 8*t*. The phantom dimple 24 is postulated to have a volume that is equal to the volume of the triple radius dimple 8*t*. The phantom curvature radius Rx is usually 5.0 mm or greater and 25.0 mm or less.

The first side wall face 18 is convex downward. The first side wall face 18 has a curvature radius R1 that is equal to or greater than the phantom curvature radius Rx. In other words, the first side wall face 18 curves gently. The air passed through the land 10 flows along the first side wall face 18. The air flows smoothly from the land 10 toward the center of the dimple 8*t* because the first side wall face 18 has a gentle curve. The first side wall face 18 having a gentle curve moderates the concentration of stress in the vicinity of the edge E1. This triple radius dimple 8*t* prevents the golf ball 2 from the scuffing upon a hit with a short iron. The triple radius dimple 8*t* is responsible for scuff resistance of the golf ball 2. In light of the smooth air flow and scuff resistance, the curvature radius R1 is preferably equal to or greater than 7.0 mm, and particularly preferably equal to or greater than 8.0 mm. The curvature radius R1 is preferably equal to or less than 30.0 mm.

Maximum diameter line of the first side wall face 18 passes through the point E1. In other words, the first side wall face 18 does not run off the point E1 outside in the horizontal direction. Accordingly, accumulation of the air is prevented. The undermost point of the first side wall face 18 agrees with the point E2. In other words, the first side wall face 18 inclines downward from the point E1 to the point E2. Accordingly, accumulation of the air is prevented.

The second side wall face 20 is convex downward. The second side wall face 20 has a curvature radius R2 that is less than the phantom curvature radius Rx. The air passed through the first side wall face 18 flows along the second side wall face 20. Direction of the air is suddenly changed by the second side wall face 20. This change indirection enhances the dimple effect. In light of the dimple effect, the curvature radius R2 is preferably equal to or less than 0.40 time, more preferably equal to or less than 0.30 time, and particularly preferably equal to or less than 0.25 time greater than the phantom curvature radius Rx. The curvature radius R2 is preferably equal to or more than 0.10 time greater than the phantom curvature radius Rx. The curvature radius R2 is preferably 1.5 mm or greater and 5.0 mm or less.

Maximum diameter line of the second side wall face 20 passes through the point E2. In other words, the second side wall face 20 does not run off the point E2 outside in the horizontal direction. Accordingly, accumulation of the air is prevented. The undermost point of the second side wall face 20 agrees with the point E3. In other words, the second side wall face 20 inclines downward from the point E2 to the point E3. Accordingly, accumulation of the air is prevented.

The bottom face 22 is convex downward. The bottom face 22 has a curvature radius R3 that is equal to or greater than the phantom curvature radius Rx. In other words, the bottom face 22 curves gently. The air passed through the second side wall face 20 flows along the bottom face 22. The air is smoothly introduced to the opposite second side wall face 20 by means of this bottom face 22. Direction of the air is suddenly changed by the opposite second side wall face 20. This change in direction enhances the dimple effect. In light of smooth air flow, the curvature radius R3 of the bottom face 22 is preferably equal to or more than 1.10 times, and more preferably equal to or more than 1.20 times greater than the phantom curvature radius Rx. The curvature radius R3 of the bottom face 22 is preferably equal to or less than 1.70 times greater than the phantom curvature radius Rx. The curvature radius R3 is preferably equal to or greater than 7.0 mm, and particularly preferably equal to or greater than 8.0 mm. The curvature radius R3 is preferably equal to or less than 35.0 mm.

Maximum diameter line of the bottom face 22 passes through the point E3. In other words, the bottom face 22 does not run off the point E3 outside in the horizontal direction. Accordingly, accumulation of the air is prevented.

Maximum diameter D2 of the second side wall face 20 is preferably 0.60 time or more and 0.95 time or less greater than the diameter D1 of the dimple 8*t*. When the diameter D2 is less than the above range, contributing rate of the second side wall face 20 or the bottom face 22 to the dimple effect may become insufficient. In this respect, the diameter D2 is more preferably equal to or more than 0.70 time, and particularly preferably equal to or more than 0.75 time greater than the diameter D1. When the diameter D2 is beyond the above range, contributing rate of first sidewall face 18 to the dimple effect may become insufficient. In this respect, the diameter D2 is more preferably equal to or less than 0.93 time, and particularly preferably equal to or less than 0.90 time greater than the diameter D1.

Maximum diameter D3 of the bottom face 22 is preferably 0.60 time or more and 0.95 time or less greater than the diameter D2. When the diameter D3 is less than the above range, contributing rate of the bottom face 22 to the dimple effect may become insufficient. In this respect, the diameter D3 is more preferably equal to or more than 0.70 time, and particularly preferably equal to or more than 0.75 time greater than the diameter D2. When the diameter D3 is beyond the above range, contributing rate of second side wall face 20 to the dimple effect may become insufficient. In this respect, the diameter D3 is more preferably equal to or less than 0.93 time, and particularly preferably equal to or less than 0.90 time greater than the diameter D2.

What is indicated by a both-oriented arrowhead d1 in FIG. 5 is the depth of the first side wall face 18; what is indicated by a both-oriented arrowhead d2 is the depth of the second side wall face 20; and what is indicated by a both-oriented arrowhead d3 is the depth of the bottom face 22. Sum total of the depth d1, the depth d2 and the depth d3 is the depth d of the dimple 8*t*.

The depth d1 of the first side wall face 18 is preferably 0.10 time or more and 0.50 time or less greater than the depth d of the dimple 8*t*. When the depth d1 is less than the above range, contributing rate of the first side wall face 18 to the dimple effect may become insufficient. In this respect, the depth d1 is more preferably equal to or more than 0.15 time, and particularly preferably equal to or more than 0.20 time greater than the depth d. When the depth d1 is beyond the above range, contributing rate of the second side wall face 20 or the bottom face 22 to the dimple effect may become insufficient. In this respect, the depth d1 is more preferably equal to or less than 0.45 time, and particularly preferably equal to or less than 0.40 time greater than the depth d.

The depth d2 of the second side wall face 20 is preferably 0.10 time or more and 0.60 time or less greater than the depth d of the dimple 8*t*. When the depth d2 is less than the above range, contributing rate of the second side wall face 20 to the dimple effect may become insufficient. In this respect, the depth d2 is more preferably equal to or more than 0.15 time, and particularly preferably equal to or more than 0.20 time greater than the depth d. When the depth d2 is beyond the above range, contributing rate of the first side wall face 18 or the bottom face 22 to the dimple effect may become insufficient. In this respect, the depth d2 is more preferably equal to or less than 0.55 time, and particularly preferably equal to or less than 0.50 time greater than the depth d.

The depth d3 of the bottom face 22 is preferably 0.05 time or more and 0.50 time or less greater than the depth d of the dimple 8*t*. When the depth d3 is less than the above range, contributing rate of the bottom face 22 to the dimple effect may become insufficient. In this respect, the depth d3 is more preferably equal to or more than 0.10 time, and particularly preferably equal to or more than 0.15 time greater than the depth d. When the depth d3 is beyond the above range, contributing rate of the first side wall face 18 or the second side wall face 20 to the dimple effect may become insufficient. In this respect, the depth d3 is more preferably equal to or less than 0.45 time, and particularly preferably equal to or less than 0.40 time greater than the depth d.

Figure 6:
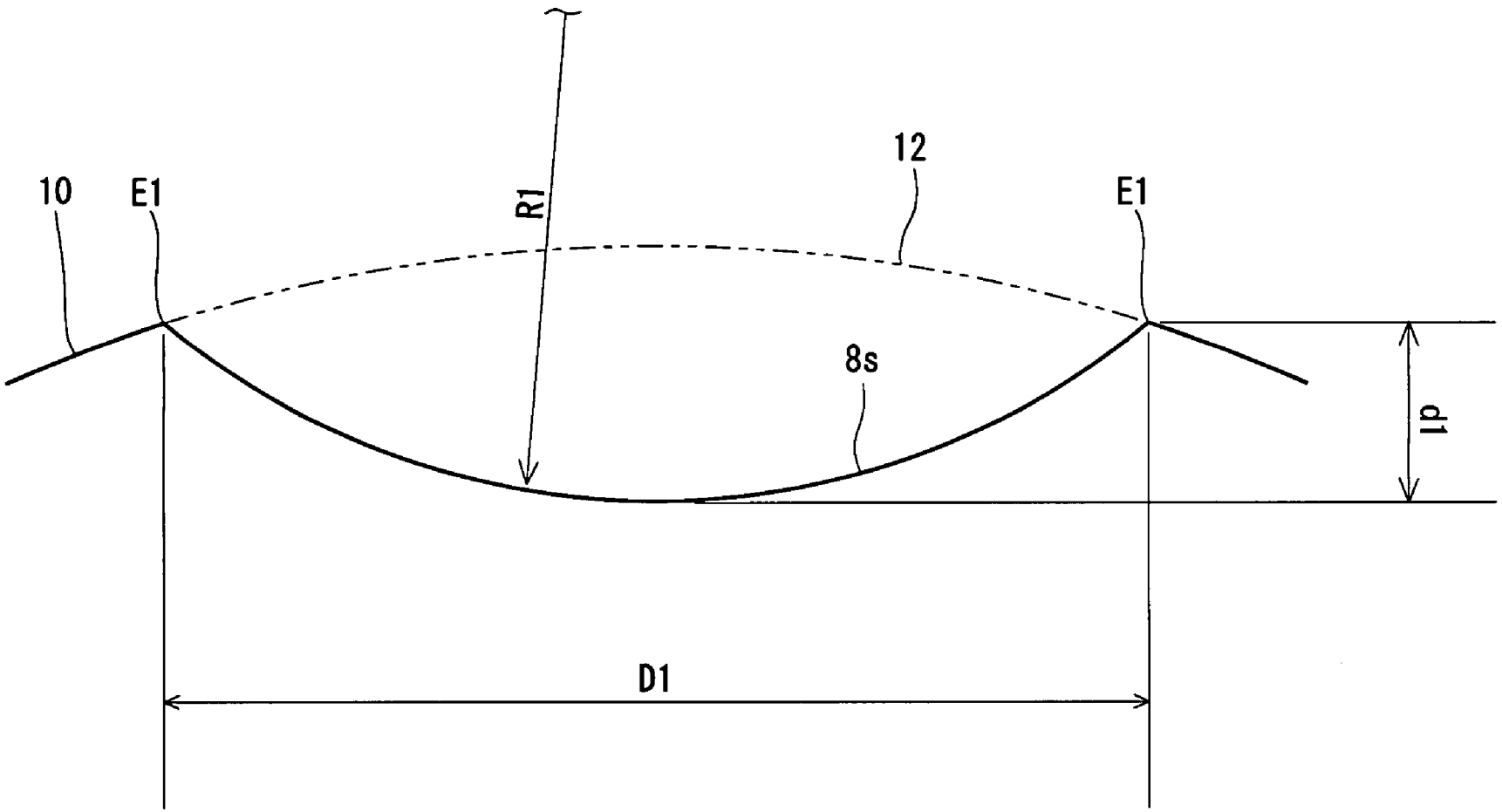
FIG. 6 is an enlarged cross-sectional view illustrating a part of the golf ball shown in FIG. 1.

FIG. 6 is an enlarged cross-sectional view illustrating a part of the golf ball 2 shown in FIG. 1. In this FIG. 6, a single radius dimple 8*s* is illustrated. This single radius dimple 8*s* has a surface having the cross-section that exhibits a circular arc. This single radius dimple 8*s* is continued to the land 10 at an edge E1. The edge E1 may be rounded. In FIG. 6, what is indicated by a both-oriented arrowhead D1 is the diameter; what is indicated by a both-oriented arrowhead d1 is the depth; and what is indicated by an arrow R1 is the curvature radius.

According to this golf ball 2, presence of the double radius dimples 8*d* and the triple radius dimples 8*t* admixed enables an extremely excellent dimple effect to be exerted. This golf ball 2 is excellent in the flight performance. In light of the flight performance, it is necessary to set the proportion Pd of the double radius dimples 8*d* to the total number of the dimples 8 to be equal to or greater than 20%, and to set the proportion Pt of the triple radius dimples 8*t* to be equal to or greater than 50%. Proportion Ps of the single radius dimples 8*s* to the total number of the dimples 8 may be zero. In light of the flight performance, the proportion Pd is more preferably equal to or greater than 24%, and particularly preferably equal to or greater than 30%. In light of the scuff resistance, the proportion Pd is preferably equal to or less than 42%, more preferably equal to or less than 40%, and particularly preferably equal to or less than 38%. In light of the flight performance and scuff resistance, the proportion Pt is preferably equal to or greater than 55%. Further, the proportion Pt is preferably equal to or less than 80%.

Area s of the double radius dimple 8*d*, the triple radius dimple 8*t* and the single radius dimple 8*s* is an area of a region surrounded by the contour line when the center of the golf ball 2 is viewed at infinity. In instances of a circular dimple, the area s is calculated by the following formula:

$$s=(D1/2)^2*\pi$$

In the golf ball 2 shown in FIG. 2 and FIG. 3, the area of the dimple A' is 20.43 $mm^2$; the area of the dimple B' is 19.63 $mm^2$; the area of the dimple C is 16.62 $mm^2$; the area of the dimple C' is 16.62 $mm^2$; the area of the dimple D is 15.90 $mm^2$; the area of the dimple D' is 15.90 $mm^2$; the area of the dimple E is 13.85 $mm^2$; the area of the dimple F" is 12.57 $mm^2$; and the area of the dimple G is 7.07 $mm^2$.

According to the present invention, ratio of total area of all the dimples 8 occupying the surface area of the phantom sphere 12 is referred to as an occupation ratio. From the standpoint that a sufficient dimple effect may be achieved, the occupation ratio is preferably equal to or greater than 70%, more preferably equal to or greater than 72%, and particularly preferably equal to or greater than 74%. The occupation ratio is preferably equal to or less than 90%. According to the golf ball 2 shown in FIG. 2 and FIG. 3, total area of the dimples 8 is 4662.2 $mm^2$. Because the surface area of the phantom sphere 12 of this golf ball 2 is 5728.0 $mm^2$, the occupation ratio is 81.4%.

According to the present invention, the term "dimple volume" means a volume of a part surrounded by a plane including the contour of the dimple 8, and the surface of the dimple 8. It is preferred that total volume of the dimples 8 is 250 $mm^3$ or greater and 400 $mm^3$ or less. When the total volume is less than the above range, a hopping trajectory may be provided. In this respect, the total volume is more preferably equal to or greater than 260 $mm^3$, and particularly preferably equal to or greater than 270 $mm^3$. When the total volume is beyond the above range, a dropping trajectory may be provided. In this respect, the total volume is more preferably equal to or less than 390 $mm^3$, and particularly preferably equal to or less than 380 $mm^3$.

A distance F between the deepest place of the dimple 8 and the phantom sphere 12 is preferably 0.10 mm or greater and 0.60 mm or less. When the distance F is less than the above range, a hopping trajectory may be provided. In this respect, the distance F is more preferably equal to or greater than 0.13 mm, and particularly preferably equal to or greater than 0.15 mm. When the distance F is beyond than the above range, a dropping trajectory may be provided. In this respect, the distance F is more preferably equal to or less than 0.55 mm, and particularly preferably equal to or less than 0.50 mm.

It is preferred that total number of the dimples 8 is 200 or greater and 500 or less. When the total number is less than the above range, the dimple effect may be hardly exerted. In this respect, the total number is more preferably equal to or greater than 240, and particularly preferably equal to or greater than 260. When the total number is beyond the above range, the dimple effect may be hardly exerted due to small size of the individual dimples 8. In this respect, the total number is more preferably equal to or less than 480, and particularly preferably equal to or less than 460.

EXAMPLES

Example 1

A rubber composition was obtained by kneading 100 parts by weight of polybutadiene (trade name "BR-11", available from JSR Corporation), 24.5 parts by weight of zinc acrylate, 10 parts by weight of zinc oxide, 15 parts by weight of barium sulfate and 0.8 part by weight of dicumyl peroxide. This rubber composition was placed into a mold having upper and lower mold half each having a hemispherical cavity, and heated at 160° C. for 20 minutes to obtain a core having a diameter of 38.1 mm. On the other hand, a resin composition was obtained by kneading 50 parts by weight of an ionomer resin (trade name "Himilan 1605", available from Du Pont-MITSUI POLYCHEMICALS Co., Ltd.), 50 parts by weight of another ionomer resin (trade name "Himilan 1706", available from Du Pont-MITSUI POLYCHEMICALS Co., Ltd.) and 3 parts by weight of titanium dioxide. The aforementioned core was placed into a mold having numerous protrusions on the inner surface, followed by injection of the aforementioned resin composition around the core according to injection molding to form a cover having a thickness of 2.3 mm. Numerous dimples having a shape inverted from the shape of the protrusion were formed on the cover. Paint was applied on this cover to give a golf ball of Example 1 having a diameter of 42.7 mm and a weight of about 45.4 g. This golf ball had a compression of about 85, a total volume of the dimples of about 320 $mm^3$, and a surface area occupation ratio of about 81%. Specifications of the dimples of this golf ball are presented in Table 1 below. The dimple F" corresponds to tips of the hold pin and bent pin of the mold for the injection molding.

Examples 2 to 4 and Comparative Examples 1 to 5

In a similar manner to Example 1 except that the mold was changed to alter specifications of the dimples as presented in Table 1, Table 2, Table 3 and Table 4 below, golf balls of Examples 2 to 4 and Comparative Examples 1 to 5 were obtained.

TABLE 1

| | Specifications of dimples | | | | | | | | | | | | | | | | | |
|---|---|---|---|---|---|---|---|---|---|---|---|---|---|---|---|---|---|---|
| | Kind | Number | Cross-sectional shape | D1 (mm) | D2 (mm) | D3 (mm) | d1 (mm) | d2 (mm) | d3 (mm) | d (mm) | F (mm) | R1 (mm) | R2 (mm) | R3 (mm) | Rx (mm) | V ($mm^3$) | D2/D1 | d1/d |
| Example 1 | A' | 24 | Double radius | 5.100 | 4.289 | — | 0.060 | 0.051 | — | 0.111 | 0.264 | 1.0 | 45.1 | — | 23.8 | 1.401 | 0.84 | 0.54 |
| | B' | 24 | Double radius | 5.000 | 4.202 | — | 0.061 | 0.050 | — | 0.110 | 0.257 | 1.0 | 44.6 | — | 22.9 | 1.346 | 0.84 | 0.55 |
| | C | 36 | Triple radius | 4.600 | 3.873 | 3.095 | 0.040 | 0.039 | 0.053 | 0.132 | 0.256 | 19.4 | 3.0 | 22.5 | 19.4 | 1.140 | 0.84 | 0.23 |
| | C' | 24 | Double radius | 4.600 | 3.908 | — | 0.061 | 0.042 | — | 0.103 | 0.227 | 1.0 | 45.4 | — | 19.4 | 1.140 | 0.85 | 0.59 |
| | D | 84 | Triple radius | 4.500 | 3.789 | 3.036 | 0.040 | 0.039 | 0.052 | 0.131 | 0.250 | 18.5 | 3.0 | 22.3 | 18.5 | 1.091 | 0.84 | 0.24 |
| | D' | 12 | Double radius | 4.500 | 3.829 | — | 0.061 | 0.041 | — | 0.102 | 0.221 | 1.0 | 44.3 | — | 18.5 | 1.091 | 0.85 | 0.60 |
| | E | 60 | Triple radius | 4.200 | 3.536 | 2.836 | 0.040 | 0.040 | 0.048 | 0.128 | 0.232 | 16.2 | 3.0 | 21.0 | 16.2 | 0.950 | 0.84 | 0.24 |
| | F" | 14 | Single radius | 4.000 | — | — | 0.137 | — | — | 0.137 | 0.231 | 14.7 | — | — | — | 0.862 | — | 1.00 |
| | G | 24 | Triple radius | 3.000 | 2.527 | 1.999 | 0.040 | 0.042 | 0.036 | 0.118 | 0.171 | 8.3 | 3.0 | 14.0 | 8.3 | 0.486 | 0.84 | 0.25 |
| Example 2 | A' | 24 | Double radius | 5.100 | 4.289 | — | 0.060 | 0.051 | — | 0.111 | 0.264 | 1.0 | 45.1 | — | 23.8 | 1.401 | 0.84 | 0.54 |
| | B' | 24 | Double radius | 5.000 | 4.202 | — | 0.061 | 0.050 | — | 0.110 | 0.257 | 1.0 | 44.6 | — | 22.9 | 1.346 | 0.84 | 0.55 |
| | C | 36 | Triple radius | 4.600 | 3.873 | 3.095 | 0.040 | 0.039 | 0.053 | 0.132 | 0.256 | 19.4 | 3.0 | 22.5 | 19.4 | 1.140 | 0.84 | 0.23 |
| | C' | 24 | Double radius | 4.600 | 3.908 | — | 0.061 | 0.042 | — | 0.103 | 0.227 | 1.0 | 45.4 | — | 19.4 | 1.140 | 0.85 | 0.59 |
| | D | 72 | Triple radius | 4.500 | 3.789 | 3.036 | 0.040 | 0.039 | 0.052 | 0.131 | 0.250 | 18.5 | 3.0 | 22.3 | 18.5 | 1.091 | 0.84 | 0.24 |
| | D' | 24 | Double radius | 4.500 | 3.829 | — | 0.061 | 0.041 | — | 0.102 | 0.221 | 1.0 | 44.3 | — | 18.5 | 1.091 | 0.85 | 0.60 |
| | E | 60 | Triple radius | 4.200 | 3.536 | 2.836 | 0.040 | 0.040 | 0.048 | 0.128 | 0.232 | 16.2 | 3.0 | 21.0 | 16.2 | 0.950 | 0.84 | 0.24 |
| | F" | 14 | Single radius | 4.000 | — | — | 0.137 | — | — | 0.137 | 0.231 | 14.7 | — | — | — | 0.862 | — | 1.00 |
| | G | 24 | Triple radius | 3.000 | 2.527 | 1.999 | 0.040 | 0.042 | 0.036 | 0.118 | 0.171 | 8.3 | 3.0 | 14.0 | 8.3 | 0.486 | 0.84 | 0.25 |

TABLE 2

| | Specifications of dimples | | | | | | | | | | | | | | | | | |
|---|---|---|---|---|---|---|---|---|---|---|---|---|---|---|---|---|---|---|
| | Kind | Number | Cross-sectional shape | D1 (mm) | D2 (mm) | D3 (mm) | d1 (mm) | d2 (mm) | d3 (mm) | d (mm) | F (mm) | R1 (mm) | R2 (mm) | R3 (mm) | Rx (mm) | V ($mm^3$) | D2/D1 | d1/d |
| Example 3 | A' | 24 | Double radius | 5.100 | 4.289 | — | 0.060 | 0.051 | — | 0.111 | 0.264 | 1.0 | 45.1 | — | 23.8 | 1.401 | 0.84 | 0.54 |
| | B' | 24 | Double radius | 5.000 | 4.202 | — | 0.061 | 0.050 | — | 0.110 | 0.257 | 1.0 | 44.6 | — | 22.9 | 1.346 | 0.84 | 0.55 |
| | C | 36 | Triple radius | 4.600 | 3.873 | 3.095 | 0.040 | 0.039 | 0.053 | 0.132 | 0.256 | 19.4 | 3.0 | 22.5 | 19.4 | 1.140 | 0.84 | 0.23 |
| | C' | 24 | Double radius | 4.600 | 3.908 | — | 0.061 | 0.042 | — | 0.103 | 0.227 | 1.0 | 45.4 | — | 19.4 | 1.140 | 0.85 | 0.59 |
| | D | 60 | Triple radius | 4.500 | 3.789 | 3.036 | 0.040 | 0.039 | 0.052 | 0.131 | 0.250 | 18.5 | 3.0 | 22.3 | 18.5 | 1.091 | 0.84 | 0.24 |
| | D' | 36 | Double radius | 4.500 | 3.829 | — | 0.061 | 0.041 | — | 0.102 | 0.221 | 1.0 | 44.3 | — | 18.5 | 1.091 | 0.85 | 0.60 |
| | E | 60 | Triple radius | 4.200 | 3.536 | 2.836 | 0.040 | 0.040 | 0.048 | 0.128 | 0.232 | 16.2 | 3.0 | 21.0 | 16.2 | 0.950 | 0.84 | 0.24 |
| | F" | 14 | Single radius | 4.000 | — | — | 0.137 | — | — | 0.137 | 0.231 | 14.7 | — | — | — | 0.862 | — | 1.00 |
| | G | 24 | Triple radius | 3.000 | 2.527 | 1.999 | 0.040 | 0.042 | 0.036 | 0.118 | 0.171 | 8.3 | 3.0 | 14.0 | 8.3 | 0.486 | 0.84 | 0.25 |
| Example 4 | A | 24 | Triple radius | 5.100 | 4.293 | 3.521 | 0.040 | 0.036 | 0.056 | 0.132 | 0.285 | 23.8 | 3.0 | 27.5 | 23.8 | 1.401 | 0.84 | 0.24 |
| | B | 24 | Triple radius | 5.000 | 4.209 | 3.519 | 0.040 | 0.036 | 0.054 | 0.130 | 0.277 | 22.9 | 3.0 | 28.5 | 22.9 | 1.346 | 0.84 | 0.24 |
| | C' | 60 | Double radius | 4.600 | 3.908 | — | 0.061 | 0.042 | — | 0.103 | 0.227 | 1.0 | 45.4 | — | 19.4 | 1.140 | 0.85 | 0.59 |
| | D | 36 | Triple radius | 4.500 | 3.789 | 3.036 | 0.040 | 0.039 | 0.052 | 0.131 | 0.250 | 18.5 | 3.0 | 22.3 | 18.5 | 1.091 | 0.84 | 0.24 |
| | D' | 60 | Double radius | 4.500 | 3.829 | — | 0.061 | 0.041 | — | 0.102 | 0.221 | 1.0 | 44.3 | — | 18.5 | 1.091 | 0.85 | 0.60 |
| | E | 60 | Triple radius | 4.200 | 3.536 | 2.836 | 0.040 | 0.040 | 0.048 | 0.128 | 0.232 | 16.2 | 3.0 | 21.0 | 16.2 | 0.950 | 0.84 | 0.24 |
| | F" | 14 | Single radius | 4.000 | — | — | 0.137 | — | — | 0.137 | 0.231 | 14.7 | — | — | — | 0.862 | — | 1.00 |
| | G | 24 | Triple radius | 3.000 | 2.527 | 1.999 | 0.040 | 0.042 | 0.036 | 0.118 | 0.171 | 8.3 | 3.0 | 14.0 | 8.3 | 0.486 | 0.84 | 0.25 |

TABLE 3

| | Kind | Number | Cross-sectional shape | D1 (mm) | D2 (mm) | D3 (mm) | d1 (mm) | d2 (mm) | d3 (mm) | d (mm) | F (mm) | R1 (mm) | R2 (mm) | R3 (mm) | Rx (mm) | V ($mm^3$) | D2/D1 | d1/d |
|---|---|---|---|---|---|---|---|---|---|---|---|---|---|---|---|---|---|---|
| | | | | Specifications of dimples | | | | | | | | | | | | | | |
| Comp. Example 1 | A" | 24 | Single radius | 5.100 | — | — | 0.137 | — | — | 0.137 | 0.290 | 23.8 | — | — | — | 1.401 | — | 1.00 |
| | B" | 24 | Single radius | 5.000 | — | — | 0.137 | — | — | 0.137 | 0.284 | 22.9 | — | — | — | 1.346 | — | 1.00 |
| | C" | 60 | Single radius | 4.600 | — | — | 0.137 | — | — | 0.137 | 0.261 | 19.4 | — | — | — | 1.140 | — | 1.00 |
| | D" | 96 | Single radius | 4.500 | — | — | 0.137 | — | — | 0.137 | 0.256 | 18.5 | — | — | — | 1.091 | — | 1.00 |
| | E" | 60 | Single radius | 4.200 | — | — | 0.137 | — | — | 0.137 | 0.241 | 16.2 | — | — | — | 0.950 | — | 1.00 |
| | F" | 14 | Single radius | 4.000 | — | — | 0.137 | — | — | 0.137 | 0.231 | 14.7 | — | — | — | 0.862 | — | 1.00 |
| | G" | 24 | Single radius | 3.000 | — | — | 0.137 | — | — | 0.137 | 0.190 | 8.3 | — | — | — | 0.486 | — | 1.00 |
| Comp. Example 2 | A' | 24 | Double radius | 5.100 | 4.289 | — | 0.060 | 0.051 | — | 0.111 | 0.264 | 1.0 | 45.1 | — | 23.8 | 1.401 | 0.84 | 0.54 |
| | B' | 24 | Double radius | 5.000 | 4.202 | — | 0.061 | 0.050 | — | 0.110 | 0.257 | 1.0 | 44.6 | — | 22.9 | 1.346 | 0.84 | 0.55 |
| | C' | 60 | Double radius | 4.600 | 3.908 | — | 0.061 | 0.042 | — | 0.103 | 0.227 | 1.0 | 45.4 | — | 19.4 | 1.140 | 0.85 | 0.59 |
| | D' | 96 | Double radius | 4.500 | 3.829 | — | 0.061 | 0.041 | — | 0.102 | 0.221 | 1.0 | 44.3 | — | 18.5 | 1.091 | 0.85 | 0.60 |
| | E' | 60 | Double radius | 4.200 | 3.571 | — | 0.061 | 0.040 | — | 0.101 | 0.205 | 1.0 | 40.0 | — | 16.2 | 0.950 | 0.85 | 0.60 |
| | F" | 14 | Single radius | 4.000 | — | — | 0.137 | — | — | 0.137 | 0.231 | 14.7 | — | — | — | 0.862 | — | 1.00 |
| | G' | 24 | Double radius | 3.000 | 2.433 | — | 0.065 | 0.037 | — | 0.102 | 0.155 | 1.0 | 20.0 | — | 8.3 | 0.486 | 0.81 | 0.64 |
| Comp. Example 3 | A | 24 | Triple radius | 5.100 | 4.293 | 3.521 | 0.040 | 0.036 | 0.056 | 0.132 | 0.285 | 23.8 | 3.0 | 27.5 | 23.8 | 1.401 | 0.84 | 0.24 |
| | B | 24 | Triple radius | 5.000 | 4.209 | 3.519 | 0.040 | 0.036 | 0.054 | 0.130 | 0.277 | 22.9 | 3.0 | 28.5 | 22.9 | 1.346 | 0.84 | 0.24 |
| | C | 60 | Triple radius | 4.600 | 3.873 | 3.095 | 0.040 | 0.039 | 0.053 | 0.132 | 0.256 | 19.4 | 3.0 | 22.5 | 19.4 | 1.140 | 0.84 | 0.23 |
| | D | 96 | Triple radius | 4.500 | 3.789 | 3.036 | 0.040 | 0.039 | 0.052 | 0.131 | 0.250 | 18.5 | 3.0 | 22.3 | 18.5 | 1.091 | 0.84 | 0.24 |
| | E | 60 | Triple radius | 4.200 | 3.536 | 2.836 | 0.040 | 0.040 | 0.048 | 0.128 | 0.232 | 16.2 | 3.0 | 21.0 | 16.2 | 0.950 | 0.84 | 0.24 |
| | F" | 14 | Single radius | 4.000 | — | — | 0.137 | — | — | 0.137 | 0.231 | 14.7 | — | — | — | 0.862 | — | 1.00 |
| | G | 24 | Triple radius | 3.000 | 2.527 | 1.999 | 0.040 | 0.042 | 0.036 | 0.118 | 0.171 | 8.3 | 3.0 | 14.0 | 8.3 | 0.486 | 0.84 | 0.25 |

TABLE 4

| | Kind | Number | Cross-sectional shape | D1 (mm) | D2 (mm) | D3 (mm) | d1 (mm) | d2 (mm) | d3 (mm) | d (mm) | F (mm) | R1 (mm) | R2 (mm) | R3 (mm) | Rx (mm) | V ($mm^3$) | D2/D1 | d1/d |
|---|---|---|---|---|---|---|---|---|---|---|---|---|---|---|---|---|---|---|
| | | | | Specifications of dimples | | | | | | | | | | | | | | |
| Comp. Example 4 | A' | 24 | Double radius | 5.100 | 4.289 | — | 0.060 | 0.051 | — | 0.111 | 0.264 | 1.0 | 45.1 | — | 23.8 | 1.401 | 0.84 | 0.54 |
| | B' | 24 | Double radius | 5.000 | 4.202 | — | 0.061 | 0.050 | — | 0.110 | 0.257 | 1.0 | 44.6 | — | 22.9 | 1.346 | 0.84 | 0.55 |
| | C | 60 | Triple radius | 4.600 | 3.873 | 3.095 | 0.040 | 0.039 | 0.053 | 0.132 | 0.256 | 19.4 | 3.0 | 22.5 | 19.4 | 1.140 | 0.84 | 0.23 |
| | D | 96 | Triple radius | 4.500 | 3.789 | 3.036 | 0.040 | 0.039 | 0.052 | 0.131 | 0.250 | 18.5 | 3.0 | 22.3 | 18.5 | 1.091 | 0.84 | 0.24 |
| | E | 60 | Triple radius | 4.200 | 3.536 | 2.836 | 0.040 | 0.040 | 0.048 | 0.128 | 0.232 | 16.2 | 3.0 | 21.0 | 16.2 | 0.950 | 0.84 | 0.24 |
| | F" | 14 | Single radius | 4.000 | — | — | 0.137 | — | — | 0.137 | 0.231 | 14.7 | — | — | — | 0.862 | — | 1.00 |
| | G | 24 | Triple radius | 3.000 | 2.527 | 1.999 | 0.040 | 0.042 | 0.036 | 0.118 | 0.171 | 8.3 | 3.0 | 14.0 | 8.3 | 0.486 | 0.84 | 0.25 |
| Comp. Example 5 | A | 24 | Triple radius | 5.100 | 4.293 | 3.521 | 0.040 | 0.036 | 0.056 | 0.132 | 0.285 | 23.8 | 3.0 | 27.5 | 23.8 | 1.401 | 0.84 | 0.24 |
| | B | 24 | Triple radius | 5.000 | 4.209 | 3.519 | 0.040 | 0.036 | 0.054 | 0.130 | 0.277 | 22.9 | 3.0 | 28.5 | 22.9 | 1.346 | 0.84 | 0.24 |
| | C' | 60 | Double radius | 4.600 | 3.908 | — | 0.061 | 0.042 | — | 0.103 | 0.227 | 1.0 | 45.4 | — | 19.4 | 1.140 | 0.85 | 0.59 |
| | D | 24 | Triple radius | 4.500 | 3.789 | 3.036 | 0.040 | 0.039 | 0.052 | 0.131 | 0.250 | 18.5 | 3.0 | 22.3 | 18.5 | 1.091 | 0.84 | 0.24 |
| | D' | 72 | Double radius | 4.500 | 3.829 | — | 0.061 | 0.041 | — | 0.102 | 0.221 | 1.0 | 44.3 | — | 18.5 | 1.091 | 0.85 | 0.60 |
| | E | 60 | Triple radius | 4.200 | 3.536 | 2.836 | 0.040 | 0.040 | 0.048 | 0.128 | 0.232 | 16.2 | 3.0 | 21.0 | 16.2 | 0.950 | 0.84 | 0.24 |
| | F" | 14 | Single radius | 4.000 | — | — | 0.137 | — | — | 0.137 | 0.231 | 14.7 | — | — | — | 0.862 | — | 1.00 |
| | G | 24 | Triple radius | 3.000 | 2.527 | 1.999 | 0.040 | 0.042 | 0.036 | 0.118 | 0.171 | 8.3 | 3.0 | 14.0 | 8.3 | 0.486 | 0.84 | 0.25 |

[Travel Distance Test]

A driver having a metal head (trade name "XXIO", available from Sumitomo Rubber Industries, Ltd.; shaft hardness: X, loft angle: 9°) was attached to a swing machine, available from True Temper Co. Then the golf ball was hit under the condition to provide a head speed of 49 m/sec, the launch angle being approximately 11° and giving the initial spin rate of approximately 3000 rpm. Accordingly, the distance from the launching point to the point where the ball stopped was measured. Under the condition during the test, it was almost windless. Mean values of 20 times measurement are shown in Table 5 below.

[Evaluation of Scuff Resistance]

A sand wedge (trade name "XXIO", available from Sumitomo Rubber Industries, Ltd., shaft hardness: S, loft angle: 56°) was attached to the swing machine described above. Then the golf ball was hit under the condition to provide a head speed of 21 m/sec. Accordingly, appearance of the golf ball was visually observed. Twenty golf balls were observed, and then rated into four ranks of from "A" to "D". The results are presented in Table 5 below. The rank "A" is most preferred.

TABLE 5

Results of evaluation

Figure 7:
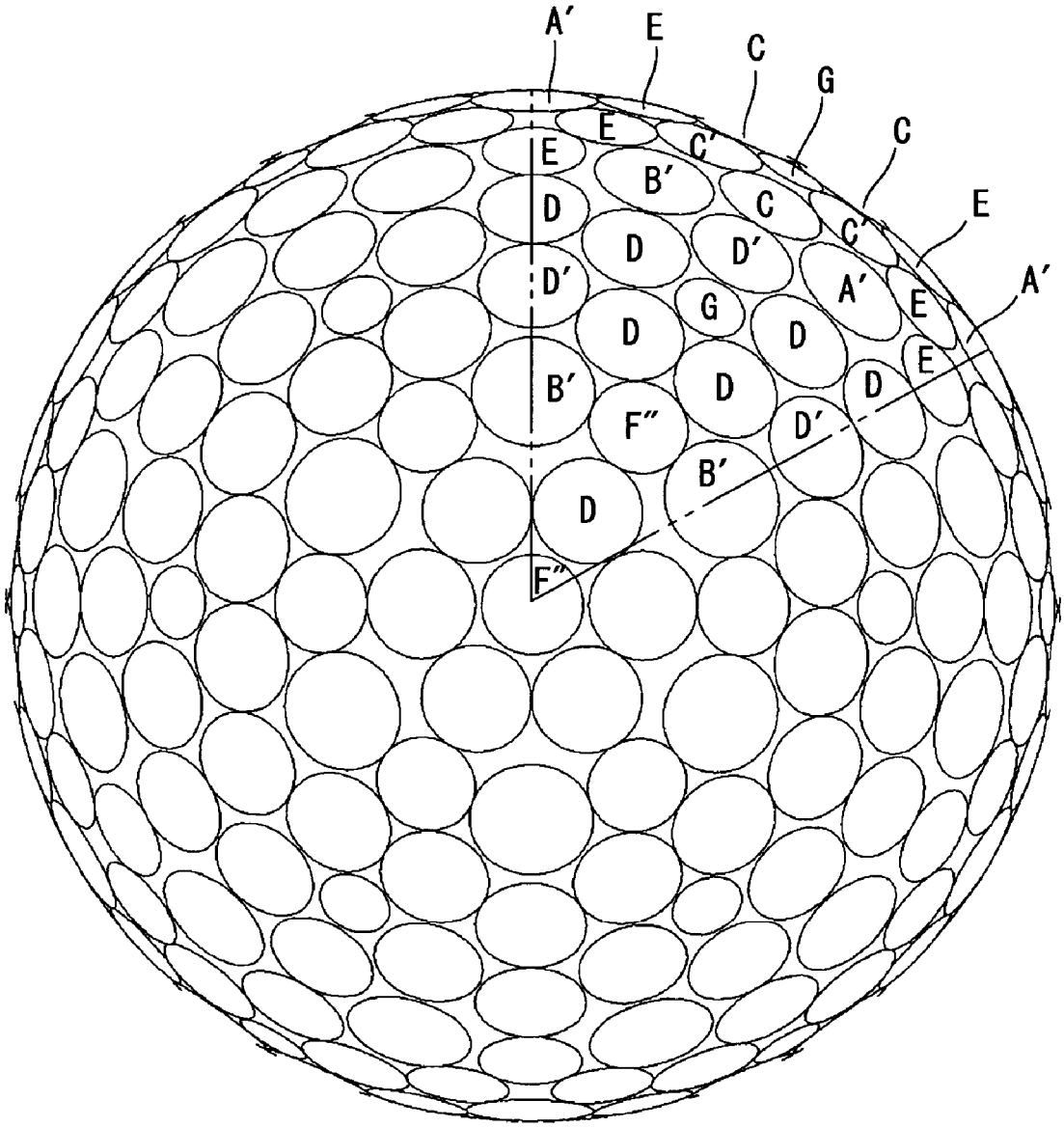
FIG. 7 is a plan view illustrating a golf ball according to Example 2 of the present invention.
Figure 8:
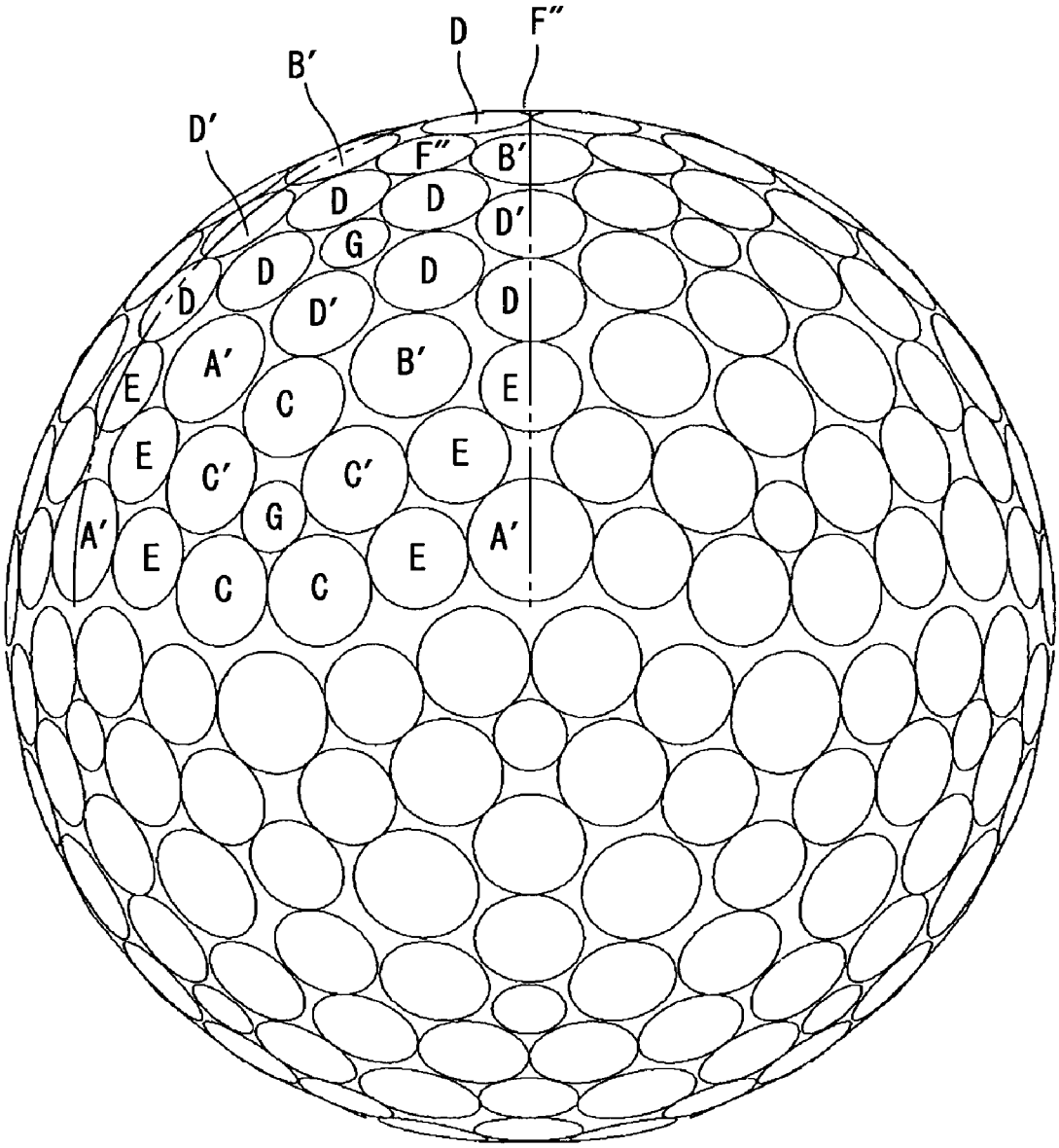
FIG. 8 is a front view illustrating the golf ball shown in FIG. 7.
Figure 9:
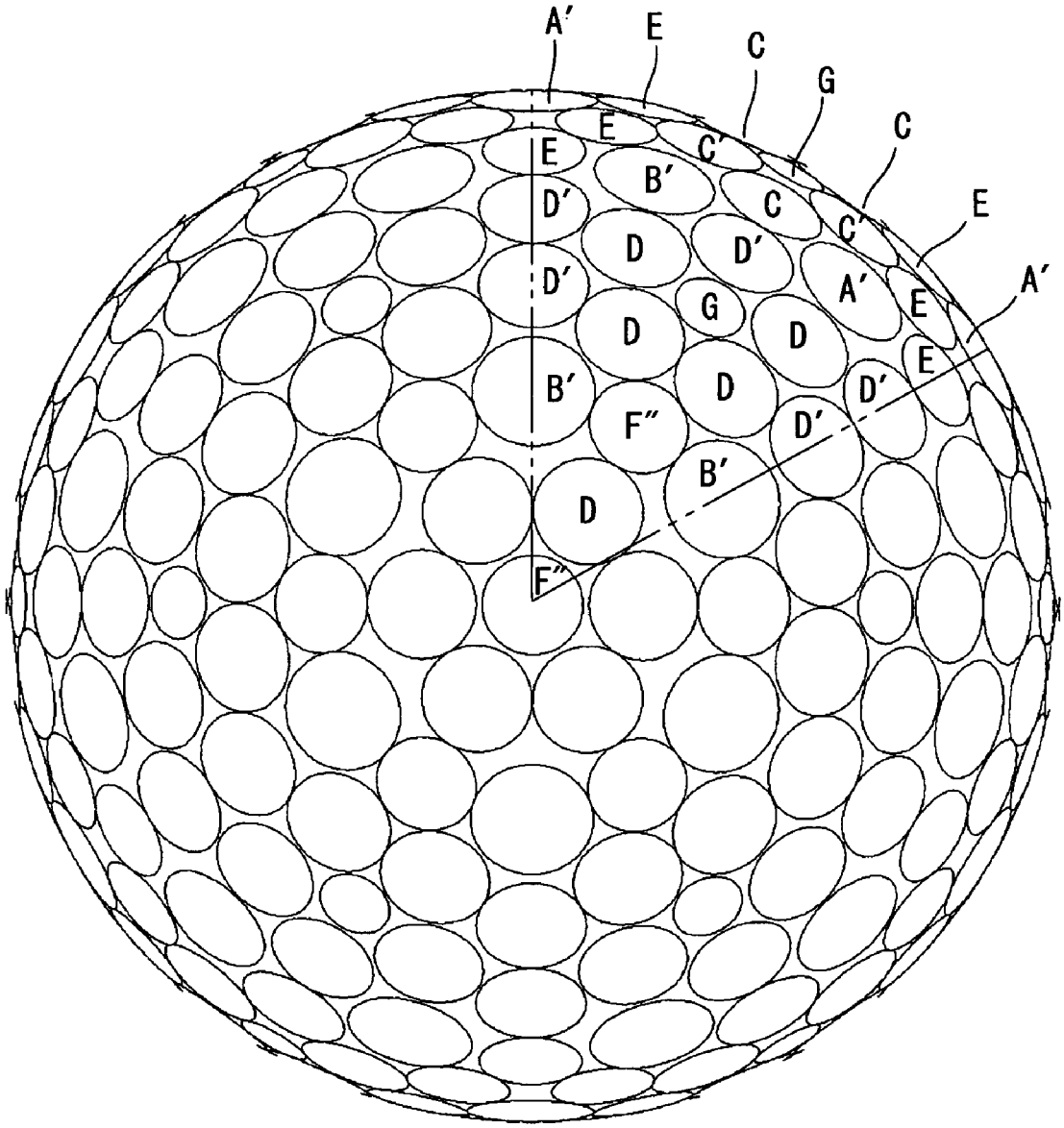
FIG. 9 is a plan view illustrating a golf ball according to Example 3 of the present invention.
Figure 10:
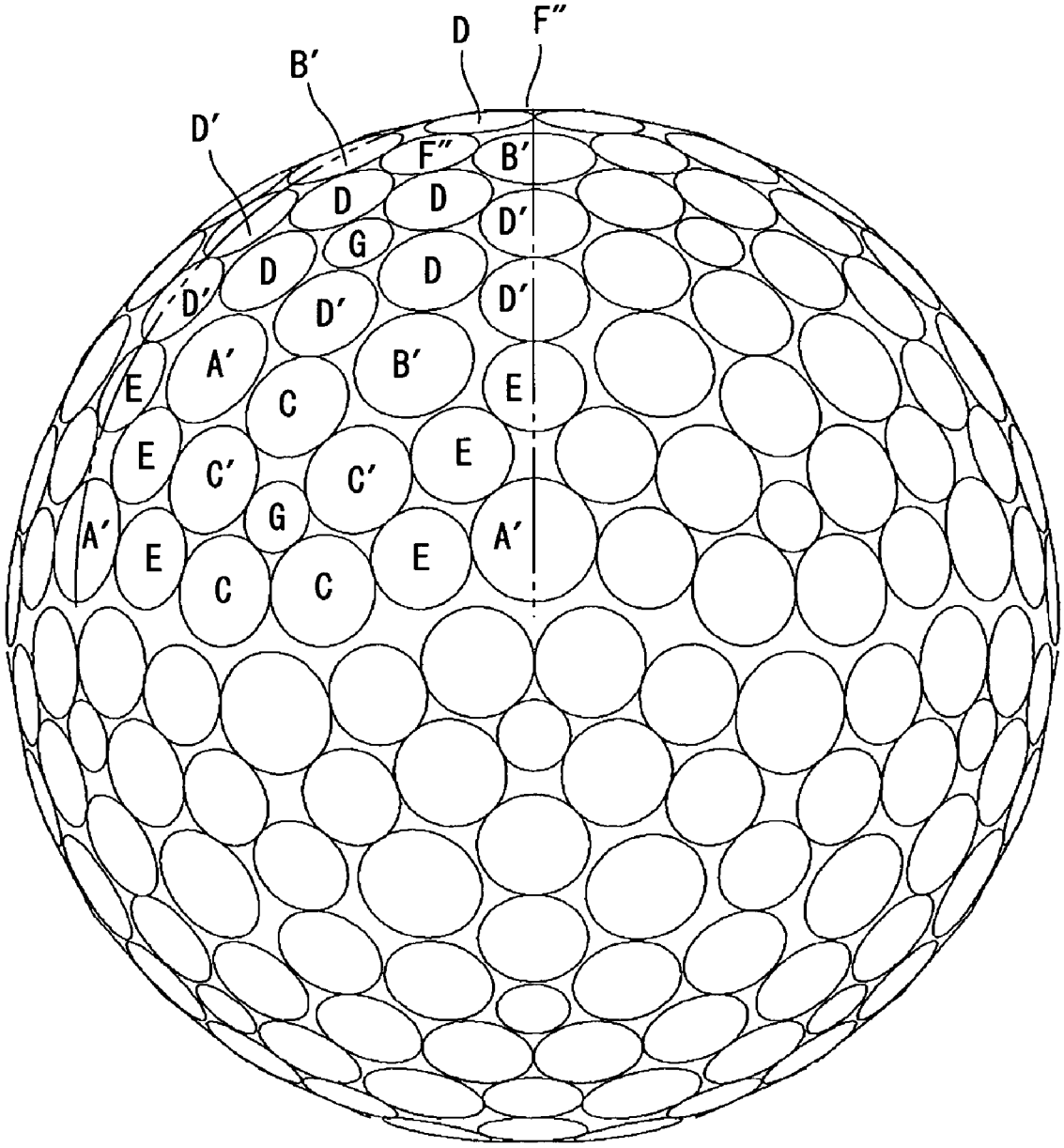
FIG. 10 is a front view illustrating the golf ball shown in FIG. 9.
Figure 11:
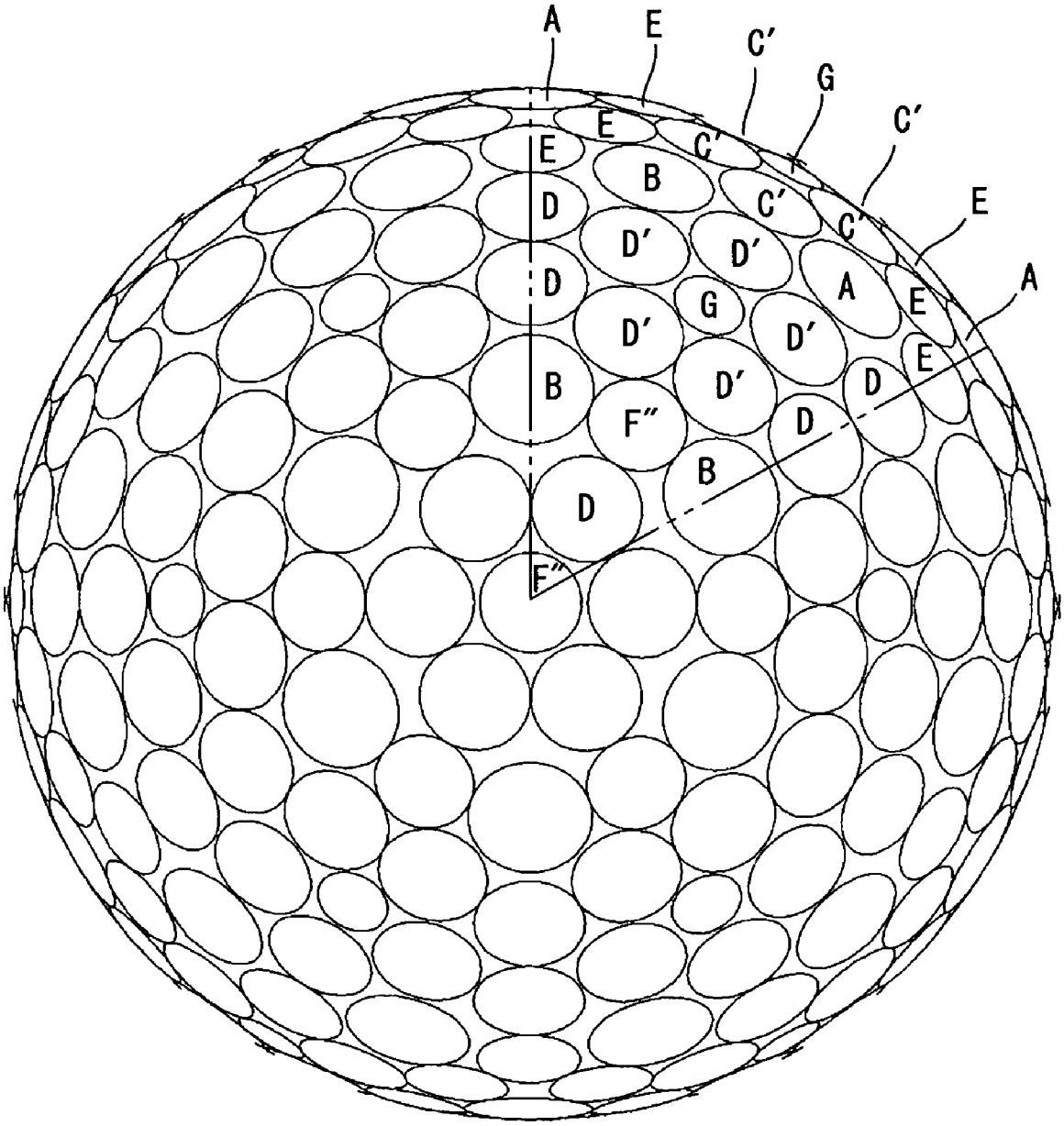
FIG. 11 is a plan view illustrating a golf ball according to Example 4 of the present invention.
Figure 12:
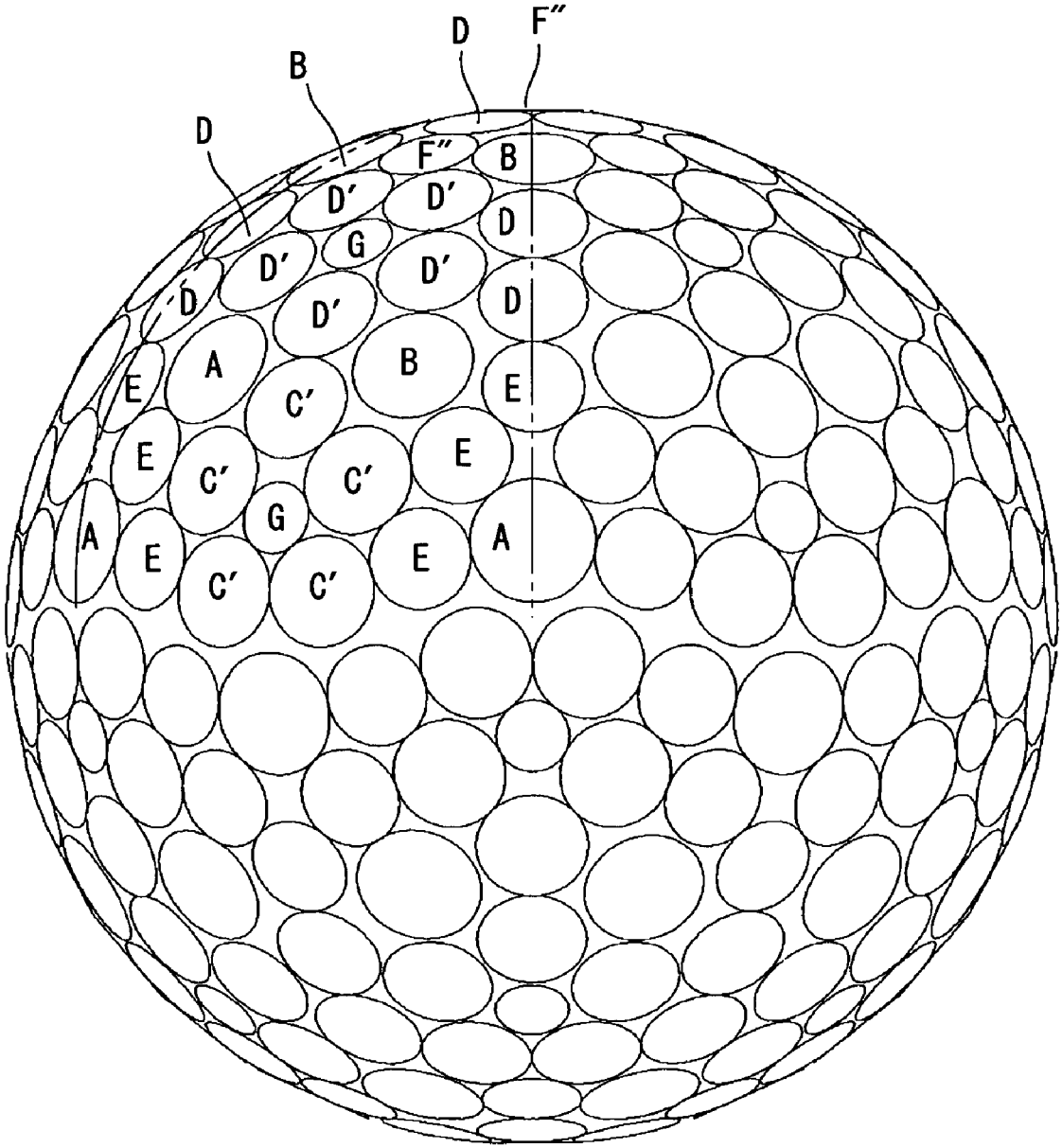
FIG. 12 is a front view illustrating the golf ball shown in FIG. 11.
Figure 13:
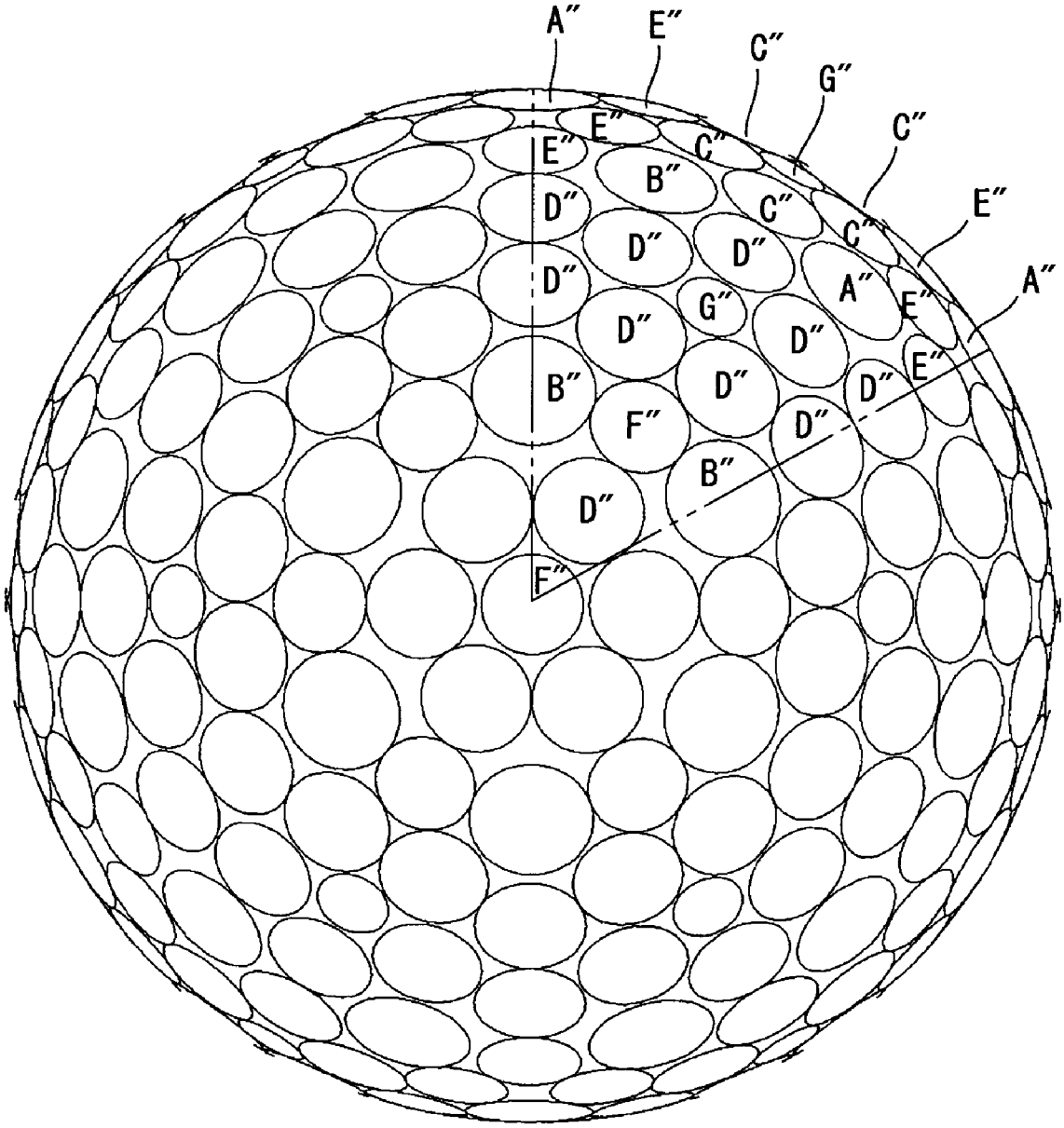
FIG. 13 is a plan view illustrating a golf ball according to Comparative Example 1.
Figure 14:
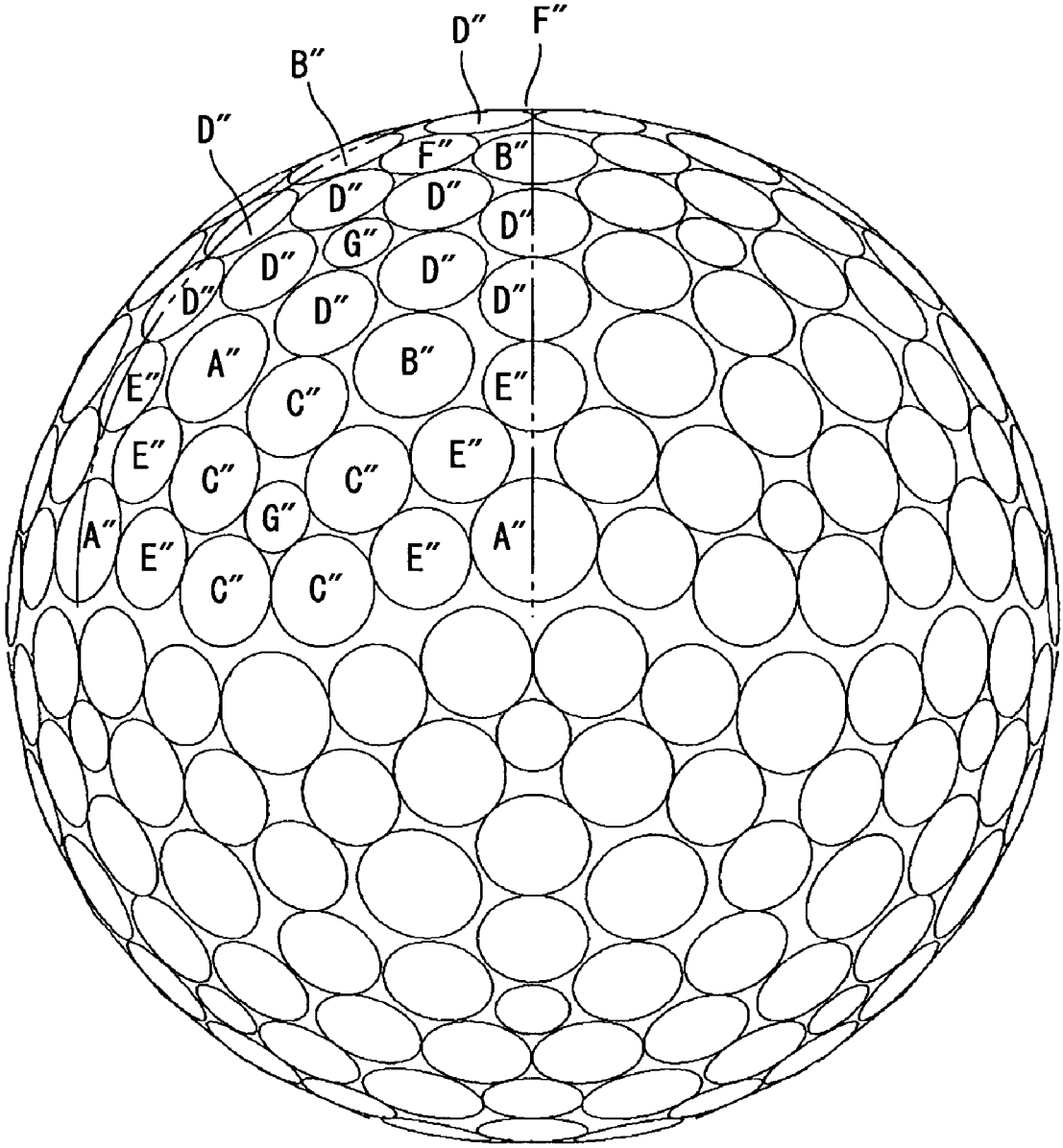
FIG. 14 is a front view illustrating the golf ball shown in FIG. 13.
Figure 15:
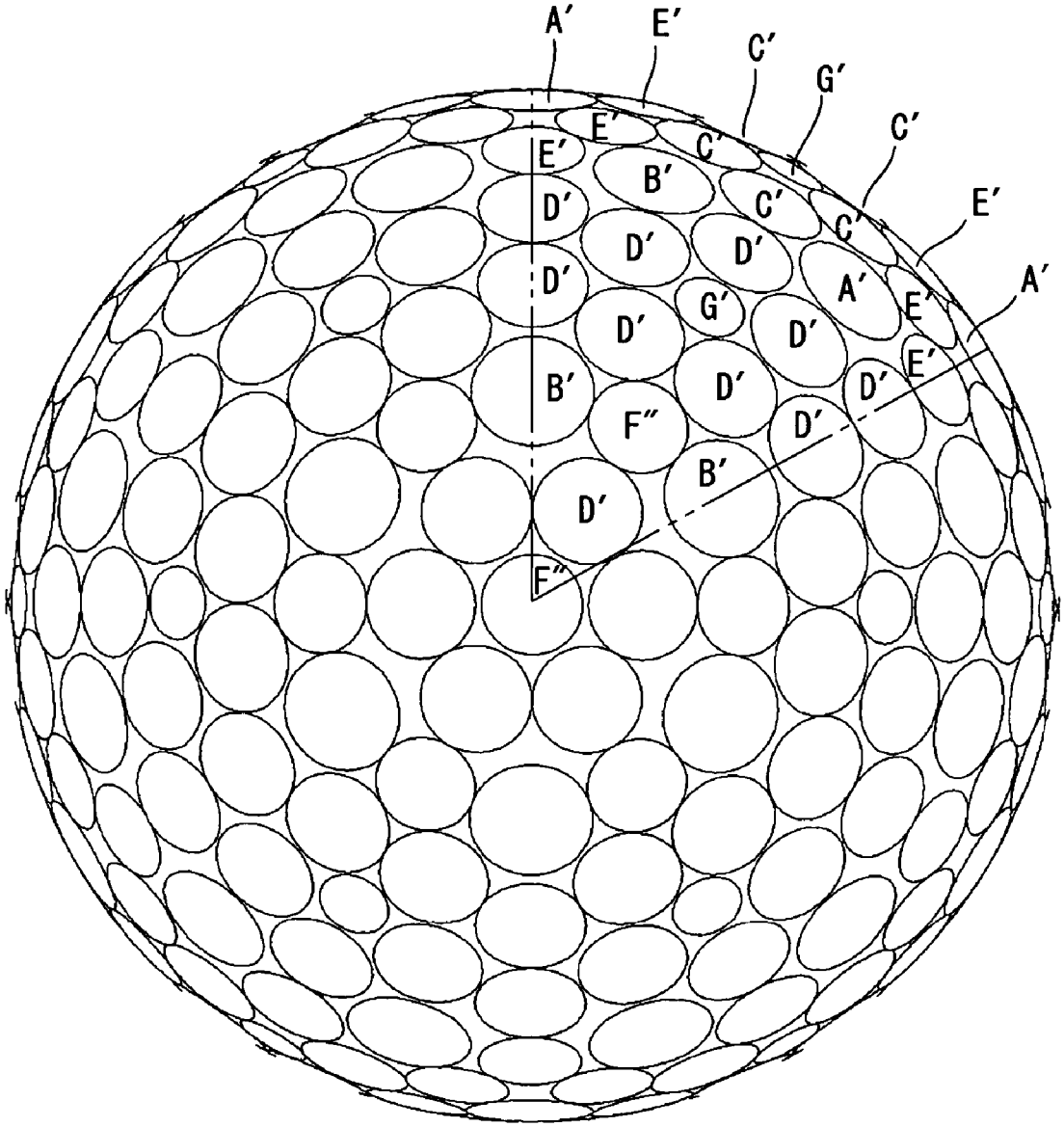
FIG. 15 is a plan view illustrating a golf ball according to Comparative Example 2.
Figure 16:
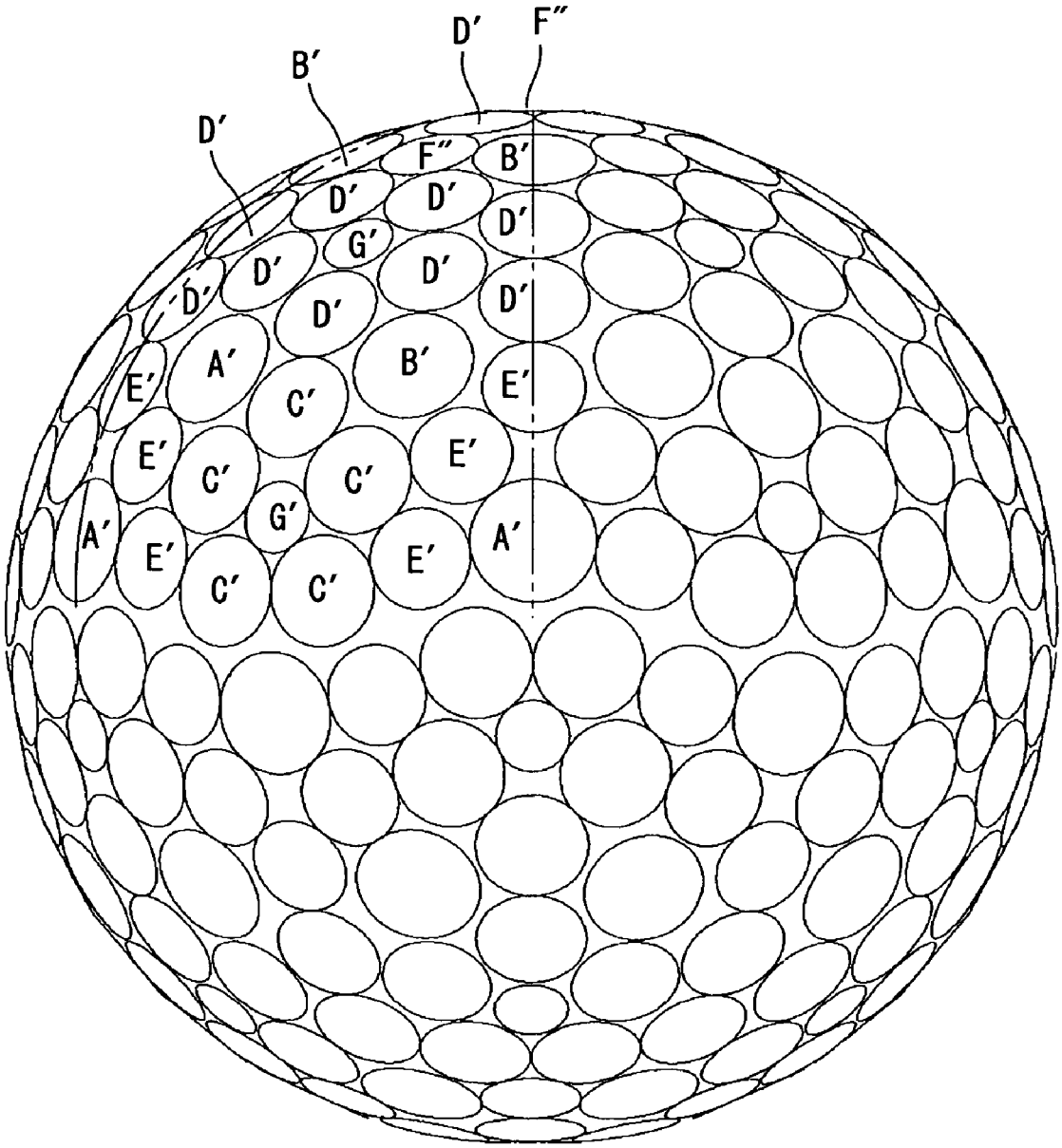
FIG. 16 is a front view illustrating the golf ball shown in FIG. 15.
Figure 17:
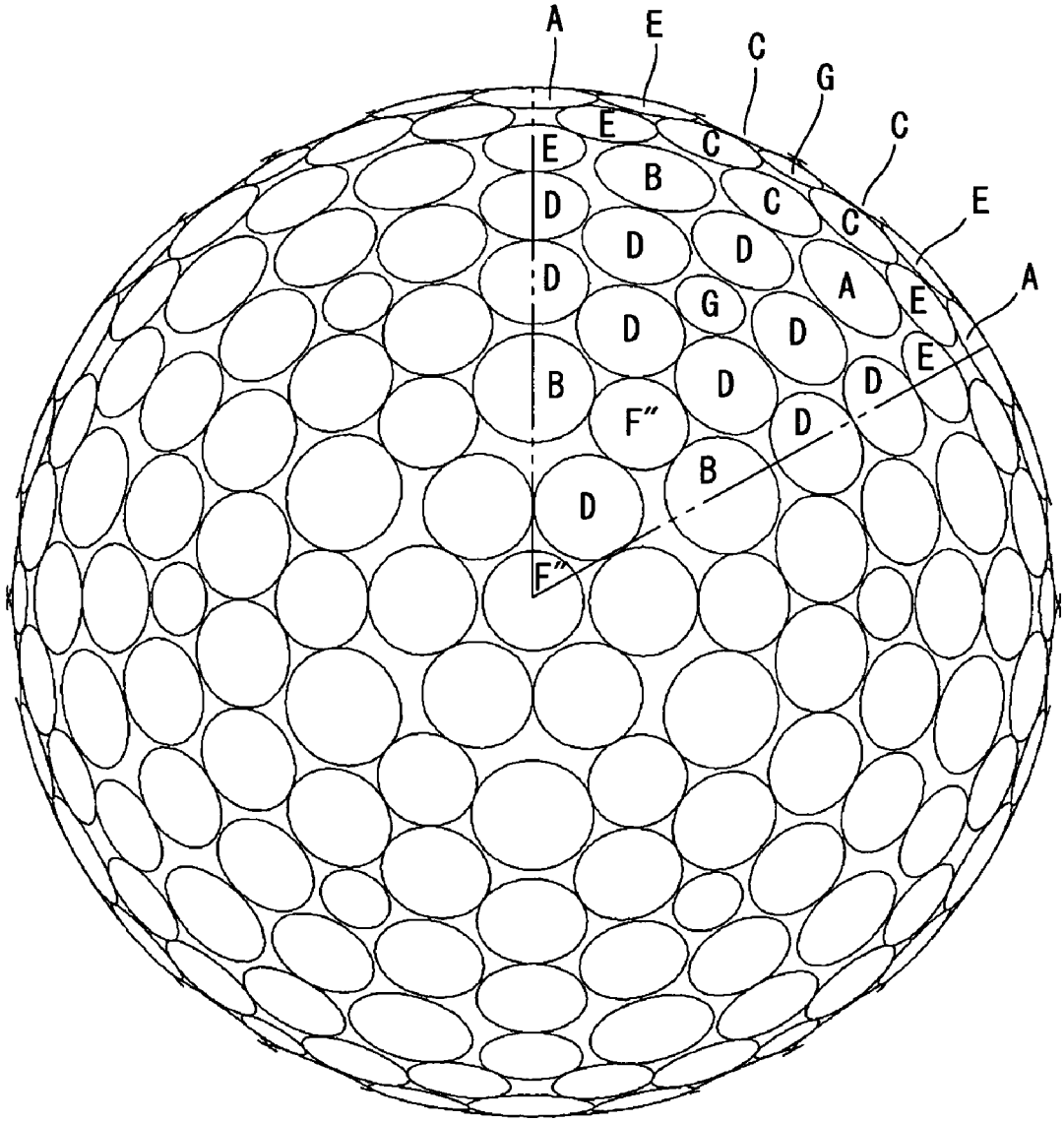
FIG. 17 is a plan view illustrating a golf ball according to Comparative Example 3.
Figure 18:
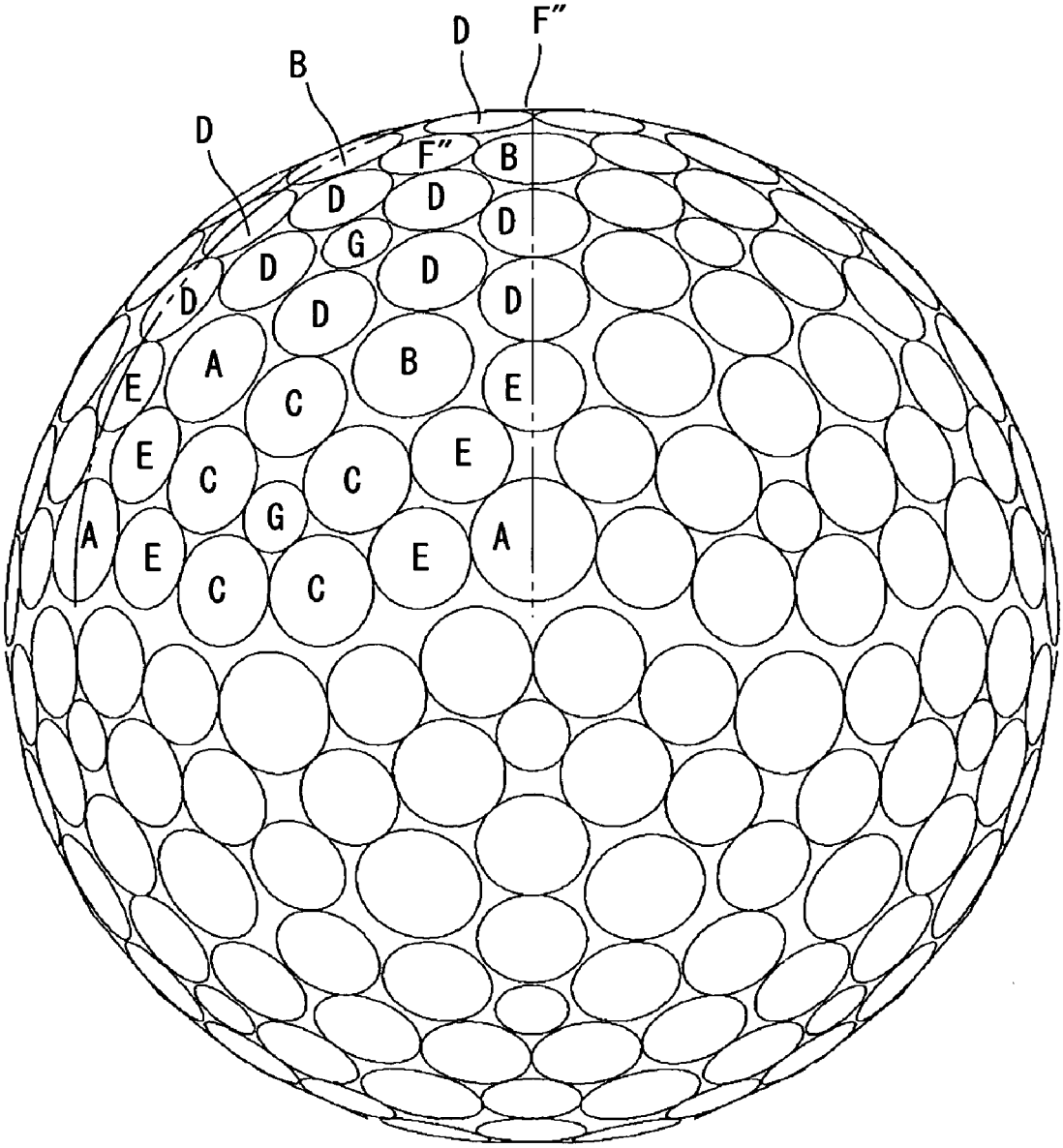
FIG. 18 is a front view illustrating the golf ball shown in FIG. 17.
Figure 19:
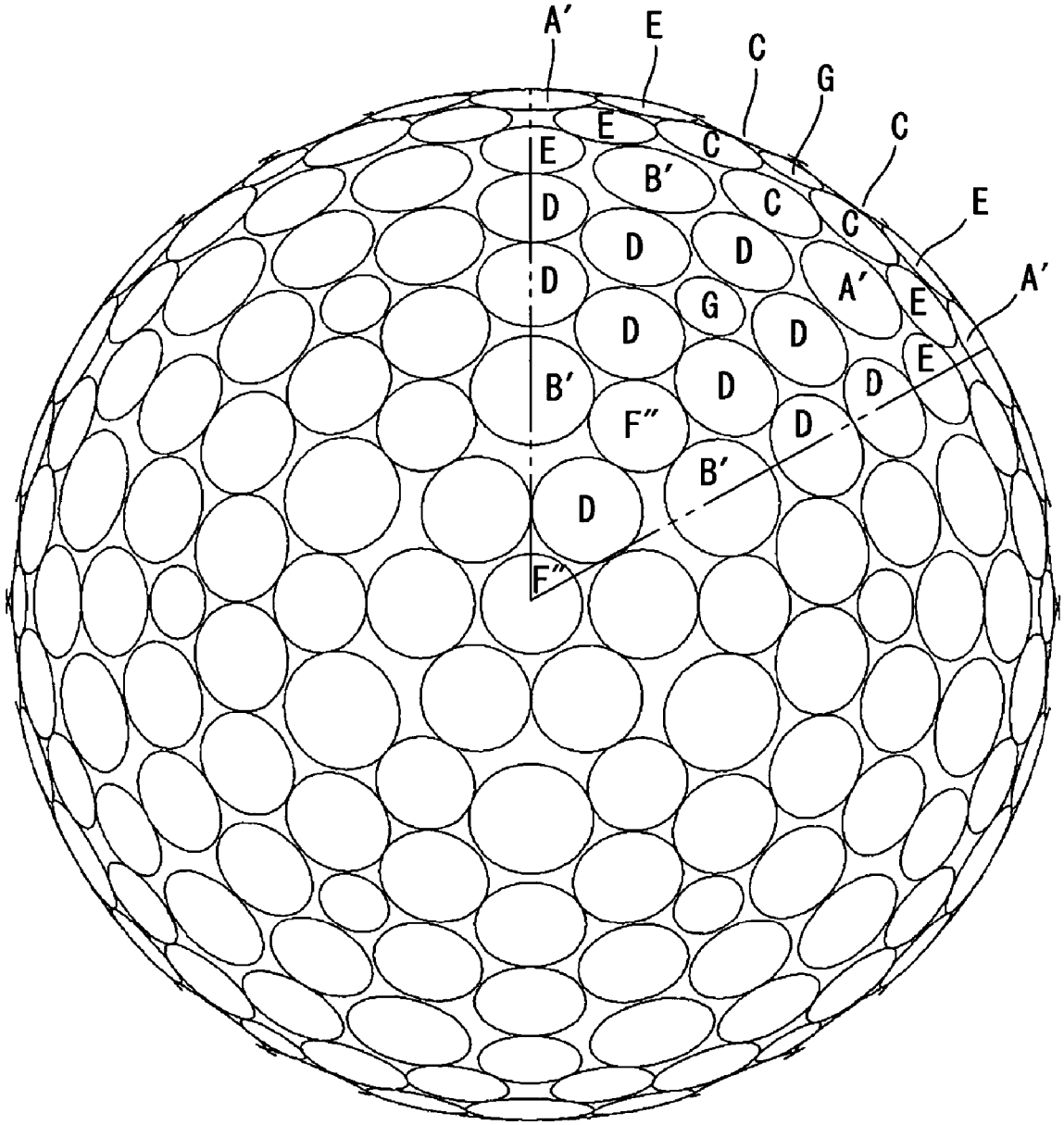
FIG. 19 is a plan view illustrating a golf ball according to Comparative Example 4.
Figure 20:
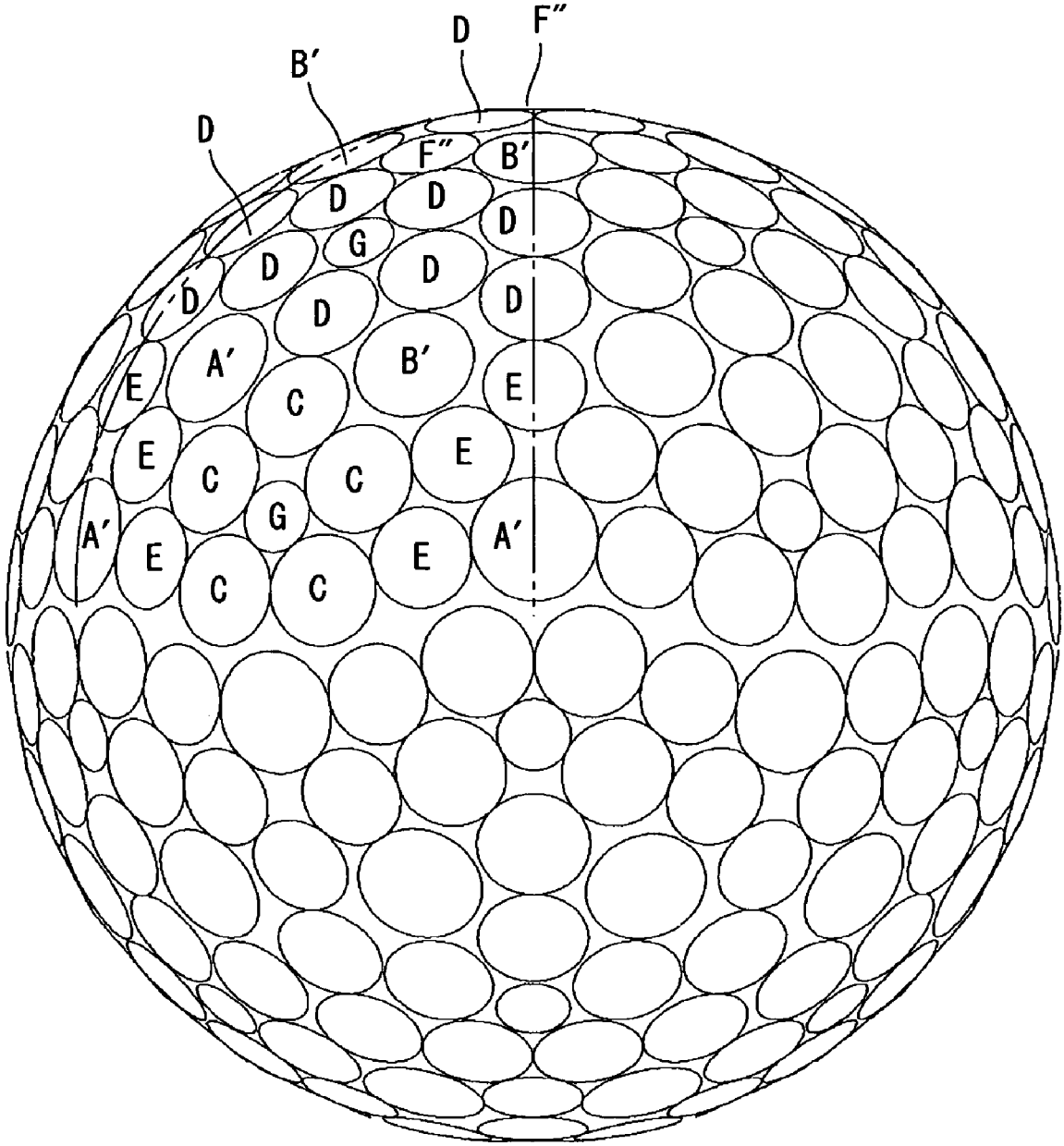
FIG. 20 is a front view illustrating the golf ball shown in FIG. 19.
Figure 21:
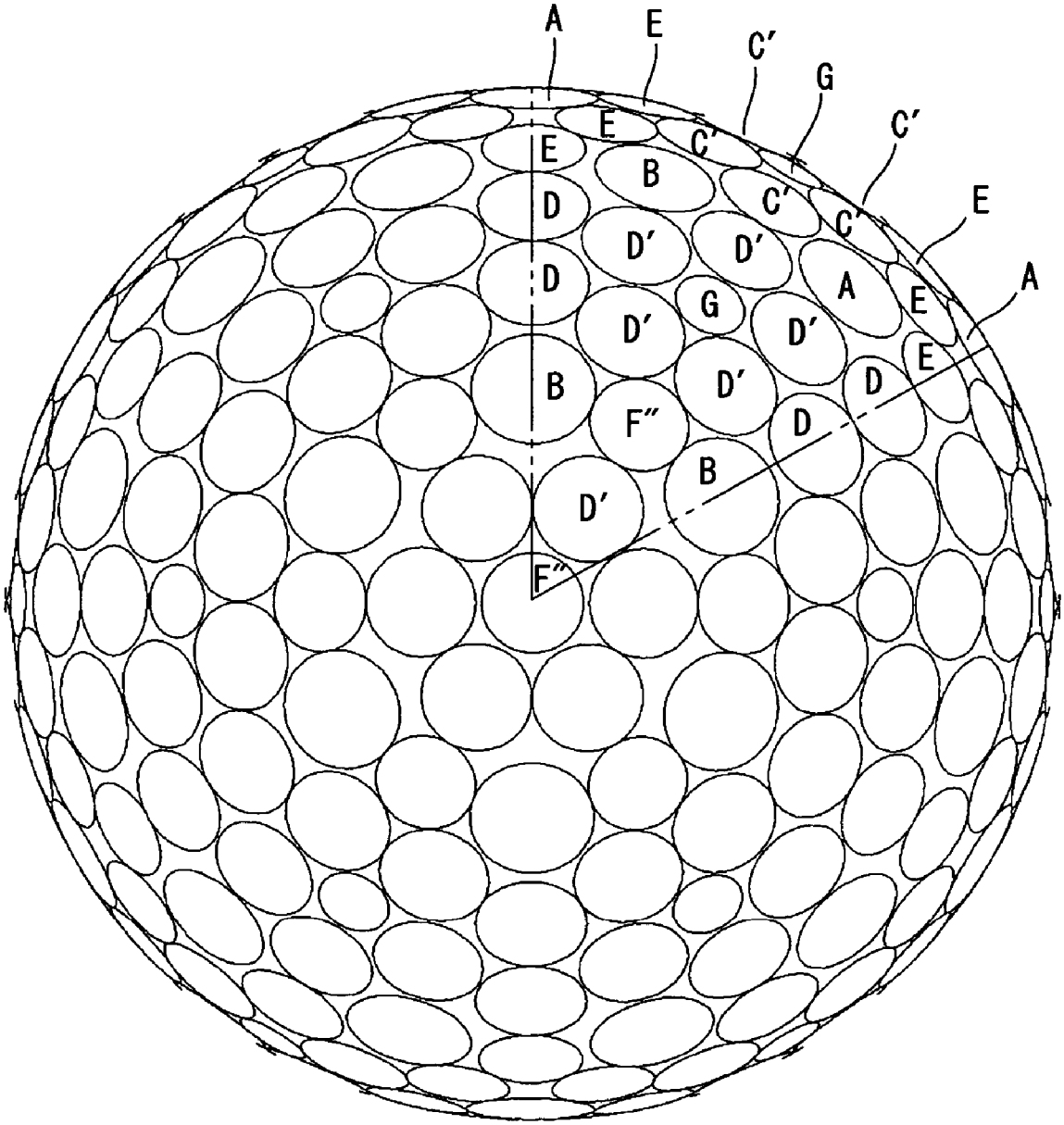
FIG. 21 is a plan view illustrating a golf ball according to Comparative Example 5.
Figure 22:
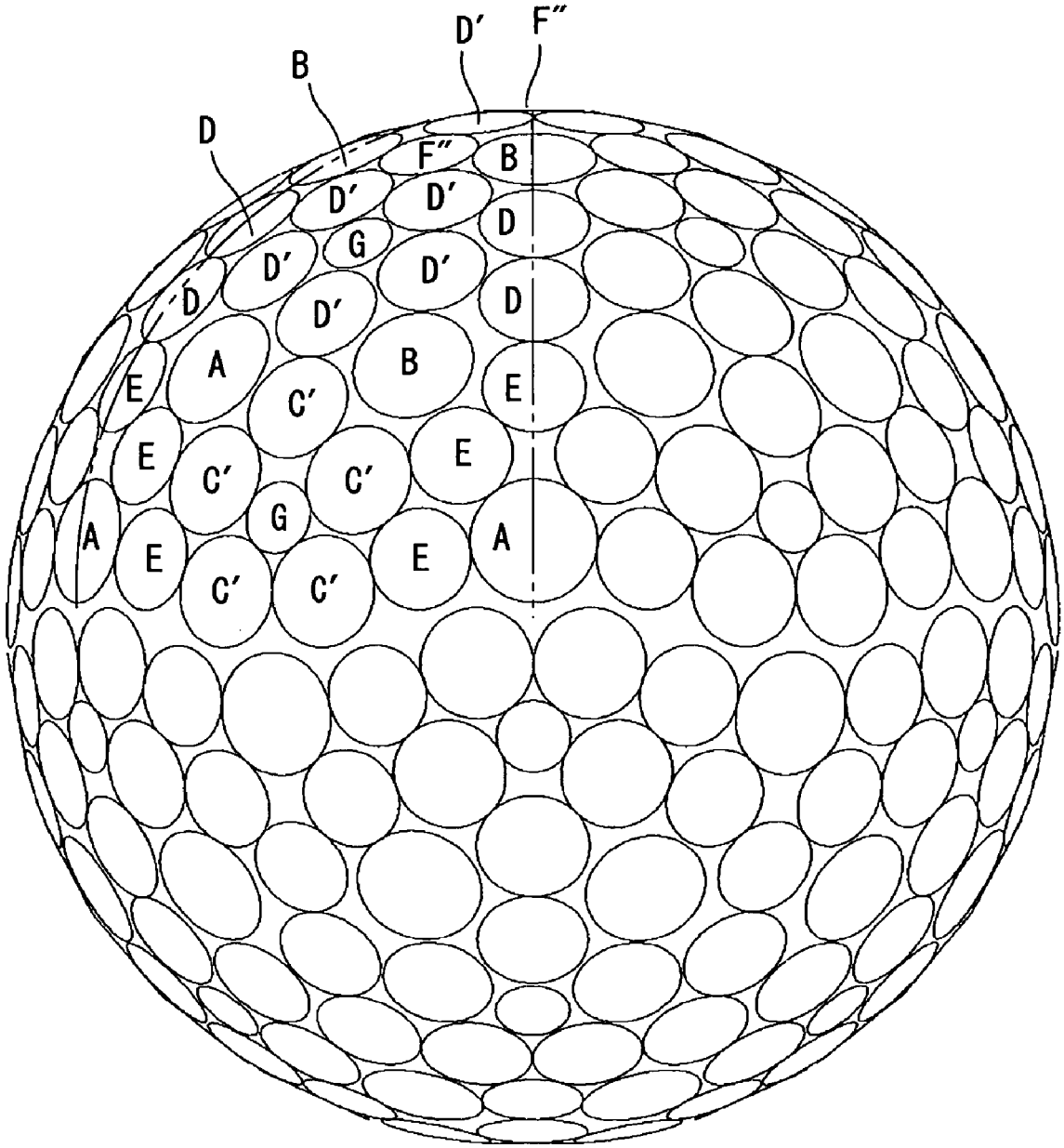
FIG. 22 is a front view illustrating the golf ball shown in FIG. 21.

| | Comp. Example 3 | Comp. Example 4 | Example 1 | Example 2 | Example 3 | Example 4 | Comp. Example 5 | Comp. Example 2 | Comp. Example 1 |
|---|---|---|---|---|---|---|---|---|---|
| Plan view | FIG. 17 | FIG. 19 | FIG. 2 | FIG. 7 | FIG. 9 | FIG. 11 | FIG. 21 | FIG. 15 | FIG. 13 |
| Front view | FIG. 18 | FIG. 20 | FIG. 3 | FIG. 8 | FIG. 10 | FIG. 12 | FIG. 22 | FIG. 16 | FIG. 14 |
| Proportion Pd of double radius dimples (%) | 0 | 16 | 28 | 32 | 36 | 40 | 44 | 95 | 0 |
| Proportion Pt of triple radius dimples (%) | 95 | 79 | 68 | 64 | 60 | 56 | 52 | 0 | 0 |
| Proportion Ps of single radius dimples (%) | 5 | 5 | 5 | 5 | 5 | 5 | 5 | 5 | 100 |
| Travel distance (m) | 236.8 | 236.0 | 237.4 | 238.1 | 239.5 | 240.1 | 240.4 | 237.2 | 233.5 |
| Scuff resistance | A | A | A | A | A | B | C | D | A |

As shown in Table 5, the golf balls of Examples are excellent in the flight performance and scuff resistance. Therefore, advantages of the present invention are clearly suggested by these results of evaluation.

The present invention is applicable to not only two-piece golf balls, but also one-piece golf balls, multi-piece golf balls and wound golf balls. The foregoing description is just for an illustrative example, therefore, various modifications can be made in the scope without departing from the principles of the present invention.

What is claimed is:

1. A golf ball having numerous double radius dimples and numerous triple radius dimples on the surface thereof, said double radius dimple comprising a first side wall face having a curvature radius R1, and a bottom face having a curvature radius R2 that is 5 times or more and 55 times or less greater than the curvature radius R1 and being positioned on the bottom side than the first side wall face, said triple radius dimple comprising:

a first side wall face having a curvature radius R1 that is equal to or greater than the phantom curvature radius Rx of the phantom dimple corresponding to a single radius dimple having an equal diameter and an equal volume to each one of said triple radius dimple;

a second side wall face being positioned on the bottom side than said first side wall face and having a curvature radius R2 that is smaller than the phantom curvature radius Rx; and a bottom face being positioned on the bottom side than said second side wall face and having a curvature radius R3 that is equal to or greater than the phantom curvature radius Rx, a proportion of the number of the double radius dimples in total number of the dimples being 20% or greater and 42% or less, and a proportion of the number of the triple radius dimples in total number of the dimples being equal to or greater than 50%.

2. The golf ball according to claim 1 wherein the depth of the first side wall face is 0.20 time or more and 0.70 time or less greater than the depth of the double radius dimple in said double radius dimple.

3. The golf ball according to claim 1 wherein the maximum diameter of the bottom face is 0.60 time or more and 0.95 time or less greater than the diameter of the double radius dimple in said double radius dimple.

4. The golf ball according to claim 1 wherein the depth of the first side wall face is 0.10 time or more and 0.50 time or less greater than the depth of the triple radius dimple in said triple radius dimple.

5. The golf ball according to claim 1 wherein the maximum diameter of the second side wall face is 0.60 time or more and 0.95 time or less greater than the diameter of the triple radius dimple in said triple radius dimple.

6. The golf ball according to claim 1 wherein the first side wall face and the bottom face of said double radius dimple, and the first side wall face, the second side wall face and the bottom face of said triple radius dimple are convex downward.

* * * * *